US011124377B2

(12) United States Patent
Rodriguez et al.

(10) Patent No.: US 11,124,377 B2
(45) Date of Patent: Sep. 21, 2021

(54) MODULAR DISPENSER FOR A PAPER WEB TURN-UP SYSTEM

(71) Applicant: Sandar Industries, Inc., Atlantic Beach, FL (US)

(72) Inventors: Peter A. Rodriguez, Jacksonville, FL (US); Jason Rodriguez, Jacksonville, FL (US); Victor Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 16/849,297

(22) Filed: Apr. 15, 2020

(65) Prior Publication Data

US 2020/0324993 A1 Oct. 15, 2020

Related U.S. Application Data

(60) Provisional application No. 62/972,969, filed on Feb. 11, 2020, provisional application No. 62/833,848, filed on Apr. 15, 2019.

(51) Int. Cl.
*B65H 19/22* (2006.01)

(52) U.S. Cl.
CPC ..... *B65H 19/22* (2013.01)

(58) Field of Classification Search
CPC ..... B65H 19/22; B65H 67/02; B65H 16/021
See application file for complete search history.

(56) References Cited

U.S. PATENT DOCUMENTS 5,299,407 A * 4/1994 Schuttler ..... B65H 67/02 53/399
5,417,383 A * 5/1995 Rodriguez ..... B65H 19/262 242/526.2
2018/0312368 A1* 11/2018 Harris ..... A41D 13/11

* cited by examiner

*Primary Examiner* — Sang K Kim
(74) *Attorney, Agent, or Firm* — Rogers Towers, P.A.; Joseph P. Kincart

(57) ABSTRACT

An improved tape delivery assembly for delivering a turn-up tape across a moving web of paper being wound onto a spool, the assembly being part of a paper web turn-up system, the tape being used to sever and transfer the leading edge of the cut paper web onto an empty spool. A secondary tape dispensing module may deliver a secondary turn-up tape while a primary tape delivery module is temporarily removed from the paper web turn-up system.

11 Claims, 44 Drawing Sheets

MODULAR DISPENSER FOR A PAPER WEB TURN-UP SYSTEM

CROSS-REFERENCE TO RELATED APPLICATIONS

This application claims the benefit of U.S. Provisional Application No. 62/833,848, filed Apr. 15, 2019, and U.S. Provisional Application No. 62/972,969, filed Feb. 11, 2020, the contents of each of which are incorporated herein by reference in their entirety.

FIELD OF THE INVENTION

This invention relates generally in a first sense to the field of devices, apparatus, systems, and methods of effecting the high-speed severing and transfer of a rapidly advancing paper web from a rotating full spool onto an empty spool, and more particularly where such an operation is performed with a dispenser that has a modular design having automated and/or manual operational modules. The modular design allows for rapid replacement of a primary module's components while the secondary module remains operable to perform a turn-up procedure. More particularly, the invention relates to modular turn-up tape dispensers and methods for dispensing transfer tape for use in paper web severing/transfer methods, wherein the transfer tape is the effecting means for severing, transferring and securing the paper web from a rotating full spool onto an empty spool.

BACKGROUND OF THE INVENTION

Modern paper manufacturing is typically performed by producing continuous lengths of paper having widths of over 400 inches, in some cases referred to as paper webs, which are wound onto spools to form rolls for subsequent converting, storage, transfer, or the like. The winding or spooling operation for the paper web occurs at high speeds, in some cases exceeding 6000 feet per minute. In order to maximize production by minimizing downtime and waste, it is desirable to sever and simultaneously transfer the moving paper web from a full spool onto an empty spool without stopping or slowing the movement of the web, or without adjusting draws (i.e. the speed differential between the incoming and outgoing web rotating support members that are not driven by a common source).

Methods and apparatus for this severing and transfer using what is known as a transfer or turn-up tape have long been known. An early example of such an apparatus is shown in U.S. Pat. No. 2,461,246 to Weyenberg, issued in 1949. Other examples are shown in my U.S. Pat. Nos. 4,659,029, 4,757,950, 4,783,018, 5,046,675, 5,453,141, 5,637,170, and 5,954,290. Further examples and detailed discussion of such equipment, systems and methodologies are presented in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062.

A failure of an apparatus or system used to dispense transfer turn-up tapes may result in prolonged failure of the transfer of paper product to a new spool. A failed transfer may result in one or more of: decreased production, inconsistent winding of the paper product and inconsistent roll sizes, excessive waste, shorter service life of equipment, and unsafe operating conditions.

SUMMARY OF THE INVENTION

Accordingly, the present invention provides apparatus and methods for a combination transfer tape dispenser incorporating a primary tape dispensing module and a secondary tape dispensing module. In some embodiments of the invention, the primary tape dispensing module is an automated module and the secondary tape dispensing module is a manual module, wherein each module may dispense transfer tape in a paper web turn-up system. The secondary operational module is useful to bridge a failure mode of the primary module due to separate primary and secondary module components. The present invention incorporates dual operation in a structure that allows for replacement of a malfunctioning transfer tape dispensing module (either manual or automated) without interference in the operation of a complimentary redundant transfer tape dispensing module.

In another aspect, the present invention provides for methods and apparatus that allow for repair of malfunctioning portions of a transfer tape dispenser without inhibiting the operation of a paper spooling machine. In some embodiments, the tape dispensing apparatus includes an automated dispensing module and a manual dispensing module, thereby providing the benefits of an automated device while maintaining the dependability and functionality of the manual device.

In still another aspect, the present invention provides apparatus and methods for rapid change out of sub-components of a primary or secondary module while maintaining functionality of the other module.

DETAILED DESCRIPTION OF THE INVENTION

Figure 1:
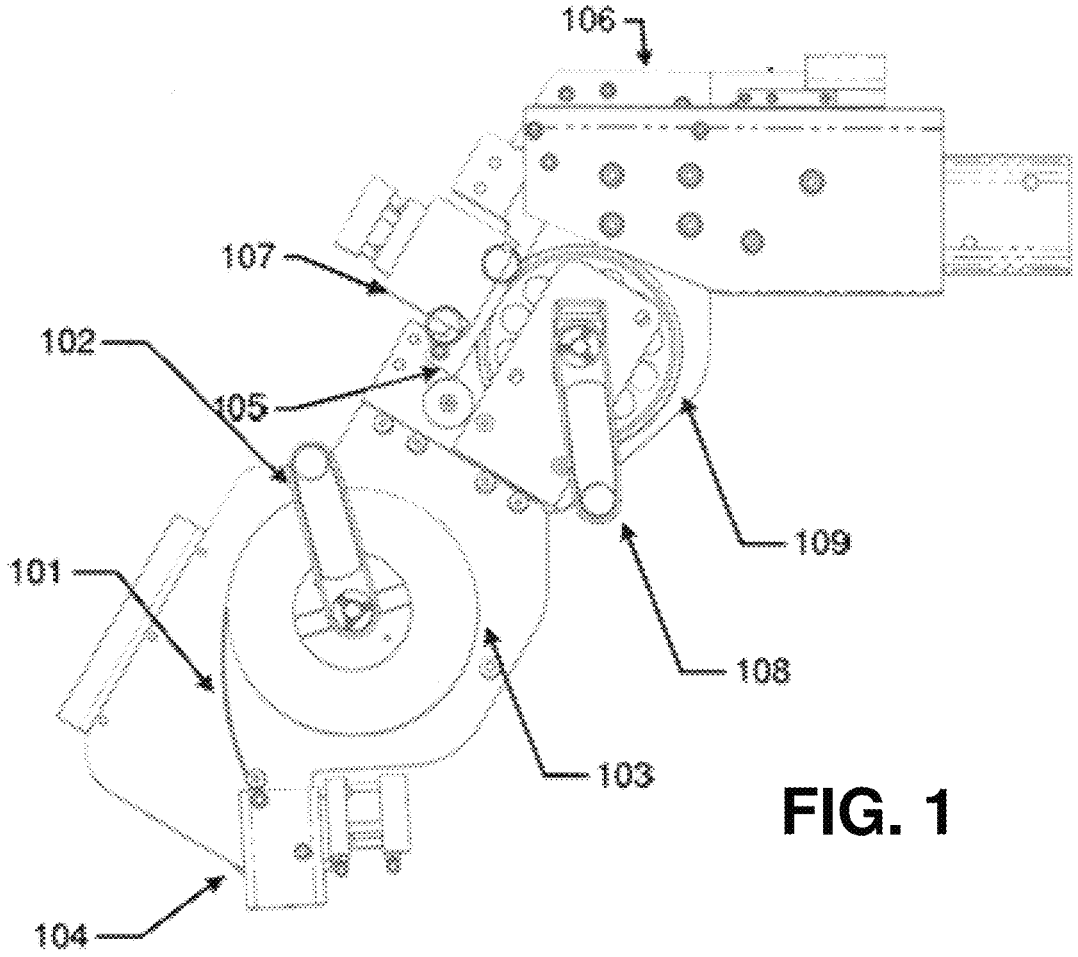
FIG. 1 illustrates a manual tape dispensing module of a transfer tape dispenser according to an embodiment the invention.

As used in the description of the invention and the appended claims, the singular forms "a," "an" and "the" are intended to include the plural forms as well, unless the context clearly indicates otherwise.

A number of embodiments of the present disclosure have been described. While this specification contains many specific implementation details, they should not be construed as limitations on the scope of any disclosures or of what may be claimed, but rather as descriptions of features specific to particular embodiments of the present disclosure. While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the form disclosed, but to the contrary, the present disclosure is to cover all modification, equivalents and alternatives falling within the spirit and scope of embodiments of the present disclosure as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Certain features that are described in this specification in the context of separate embodiments can also be implemented in combination in a single embodiment. Conversely, various features that are described in the context of a single embodiment can also be implemented in combination in multiple embodiments separately or in any suitable subcombination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while method steps may be depicted in the drawings in a particular order, this should not be understood as requiring that such operations be performed in the particular order shown or in a sequential order, or that all illustrated operations be performed, to achieve desirable results.

In general, the invention comprises apparatus and methods for dispensing a tape, and in particular, wherein the tape is a transfer tape used in a paper web turn-up operation. The term "paper web," as used herein, encompasses any other paper/wood pulp-based product and any non-woven material in which turn-up procedures are used. In a paper web turn-up operation, a continuous paper web being rolled onto a first spool is severed and transferred to an empty spool when the first spool is fully wound, the transfer occurring without requiring the flow of the paper web to be temporarily altered, slowed or stopped. Multiple embodiments of the apparatus and method which dispense transfer tapes are illustrated and described. It is to be understood that disclosure of the apparatus and methods in relation to a paper web turn-up operation is not meant to be limiting, as the dispenser structure as described is suitable for dispensing different types of tapes for different industrial applications.

As used herein, "turn-up tape," "transfer tape," "paper band," and "paper tape" may be used interchangeably. These terms refer to the tape used in a paper web turn up operation for severing and transferring a continuous paper web onto an empty spool. Any suitable transfer tape may be used, and there may be numerous designs of transfer tapes, including but not limited to repulpable paper tapes. Other forms of transfer tape may also be possible with more complicated modular device configurations. In some examples, as will be discussed with respect to the automated and manual tape dispensing modules, a single piece turn-up tape may be formed or contained in a turn-up tape dispensing module for use in a single turn up operation. Additionally, while dispensers and modules are described herein with respect to transfer tape, such apparatus and methods may be used to dispense other types of tapes known to those of skill in the art.

As used herein, the terms "tape dispenser," "transfer tape dispenser," or "tape dispensing apparatus" refer to the apparatus that includes, or is configured to include (such that a module of the dispenser may be removed as needed for repair or replacement), a primary tape dispensing module and a secondary tape dispensing module (and additional modules if desired). In particular embodiments, the tape dispenser includes an automated module as the primary tape dispensing module and the manual module as the secondary tape dispensing module, but the tape dispenser may include a second automated module or a second manual module instead. In the tape dispensing apparatus herein, each module is connected to (or configured to connect to) at least one other tape dispensing module. In connecting to the at least one other tape dispensing module, the tape dispenser may or may not include additional apparatus supports, structures, crossbeams, or connectors. For example, the dispenser may further include a track adapter block that coordinates the outputs of the primary and secondary modules, such as by merging the output tracks or by creating multiple output tracks from two or more tape dispensing modules. The track adapter block may be attached to an apparatus support separate from the modules or may be attached or integrated with the primary or secondary module. For the turn up process, the track adapter output may seamlessly integrate with the cross-machine track of the paper web turn-up system. The tape dispensing apparatus is part of a paper web turn-up system which includes other features, including the cross-machine track, brakes, electronic controls, and other features known to those of skill in the art. It will be understood that the tape dispensers described herein may be used with any suitable paper web turn-up system.

As used herein, the terms "manual module" or "manual tape dispensing module" refer to a tape dispensing device wherein the means for actuating the paper tape drive mechanism is manual, such as by use of a hand crank, and performed by an operator. While the manual drive system may in some cases use powered means including electronic, pneumatic, hydraulic, or magnetic devices, in a manual module, an operator actuates such power by use of a switch, button, or the like. The manual module is configured to connect with a second (or more) tape dispensing module(s) but may operate independently and in the absence of the other module(s). In general, the manual module in the tape dispensers described herein include a reservoir or holder for paper tape; a track body that is adapted to receive and hold the paper tape as it moves through to a discharge end of the tape dispensing module; and a drive mechanism (typically with a manual method of actuating the mechanism such as a hand crank and/or pneumatic device) such as a nip mechanism (also referred to herein as a nip cylinder) and drive wheel, pinch wheel, or other device to secure and move the paper tape to the discharge end of the manual tape dispensing module and through a cross-machine track of a paper web turn-up system. The manual module also includes a means of connecting to or integrating with an additional module such as an automated module. Such means include, but are not limited to, hinges, brackets, holes, or protrusions that are configured to attached to another module or a tape dispenser apparatus support. The manual modules may further include other housing, structures, and/or support. There are further several optional features that may be added to provide further functionality or ease of use for the manual module, including, but not limited to, a reservoir for the turn up tape, unicharger and transfer tape coil keeper, cutter, mechanical counter, view port, retractable stop, an overrunning clutch between the drive wheel and hand crank, and holder for a single use paper tape dispensing box. Each of these features will be described in further detail below.

As used herein, the terms "automated module" and "automated tape dispensing module" refer to a tape dispensing device wherein the means for actuating the paper tape drive mechanism include a motor or other powered drive mechanism. The motor or powered drive mechanism is connected to a programmable logic controller that actuates the mechanism. The automated module is configured to connect with a second (or more) tape dispensing module(s) but may operate independently and in the absence of the other module(s). In general, the automated module includes a reservoir or paper tape holder; a track body that is adapted to receive and hold the paper tape as it moves through to a discharge end of the tape dispensing module; a motor; and a drive mechanism such as a nip mechanism (also referred to herein as a nip cylinder) and drive wheel, pinch wheel, or other device actuated by the motor to move the paper tape to the discharge end of the tape dispensing module and through a cross-machine track of a paper web turn-up system. The automated module also includes a means to connect to or integrate with an additional module such as a manual module, including but not limited to hinges, brackets, holes, or protrusions that are configured to attached to another module or a tape dispenser apparatus support. The automatic modules may further include other housing, structures, and/or support. There are further several optional features that may be added to provide further functionality or ease of use for the automated module, including, but not limited to, a unicharger (e.g., a motorized unicharger) with a transfer tape coil keeper, a cutting mechanism, retractable stop, counter, view port, and holder for a single use paper tape dispensing box. Each of these features will be described in further detail below.

As used herein, the term "unicharger" refers to an optional feature of both the manual and automated modules. The unicharger is an automated or manual device that includes a winding hub and a means of spooling paper band into a paper band coil. The coiled paper band is then cut at the appropriate length for one turn up. The paper is typically spooled in the opposite direction as it was spooled in the paper tape supply. The cut end may then be fed into the drive mechanism of the tape dispensing module. An automated unicharger (also called a powered winder) spools the paper band coil via a motor and a manual unicharger (also called a hand winder) spools the paper band coil by use of a manual device such as a hand crank.

While an automated module typically has an automated unicharger, some configurations may include a manual unicharger in an automated tape dispensing module. Furthermore, in some embodiments, one or more tape dispensers may only have one unicharger, which may then be used to create paper band coils for each module. For example, if an automated tape dispensing module spools a paper band coil with an automated unicharger, the paper band coil may then be removed from the automated unicharger and transferred to a reservoir in the manual tape dispending module. The automated module can then spool another length of paper band for use in the automated tape dispensing module. As used herein, the term "unicharger" includes both manual and automated unichargers, unless otherwise specified. The benefit of the unicharger is that it eliminates the possibility of paper band tangling in a loop box or free loop; 2) allows for much less and more uniform resistance to the rapid movement of the paper band in the turn-up, reducing band breakage and failed turn-ups; and 3) may counteract the curl imparted by the paper band being coiled in one direction on the supply coil by winding it in the opposite direction (where curl contributes to the paper band snagging in the dispenser or track when pushed across the paper machine).

As described above, the present invention provides a combination tape dispenser that includes a primary tape dispensing module and a secondary tape dispensing module. The modular design of the dispenser may allow for facile replacement of a malfunctioning manual or automated module to minimize loss of paper web production. For example, in some cases, an automated turn-up paper dispensing module may be typically used to support paper operation. However, during the course of use, various events (e.g., malfunction of the device, breakage of a component of the device or the reaching of a time of usage mandating a preventative maintenance activity) may require a shutdown of the automated module. During these "down-time" events, an operator may keep the paper production machinery functioning through use of the manual dispensing module in the turn up tape dispenser.

In some events, the nature of the issue with the automated module may be serious enough to require significant maintenance activity, such activity which may be better performed with the module removed from its position proximate to the paper production machinery. The automated module may then be simply, effectively and quickly removed from the dispenser and replaced with a functional automated module, all the while using the manual module to keep the paper machinery functioning. The removed automated module may be repaired at the paper plant location or sent out to another facility for repair. The modular design and uses in manners such as this may significantly improve the efficiency of operations.

While the above process is the typical use of the combination tape dispenser, other configurations are possible. For example, an apparatus of the invention may include more than one manual dispensing module, more than one automated dispensing module, or both. The general use for more than one module is to act as a backup module, and a second manual module or a second automated module may perform that function. In addition, while particular manual and automated modules may be described herein, any type of dispensing modules (manual, automated, or both) now known, or later invented, may be combined in the modular dispenser of the invention. Furthermore, additional features now known or later invented may be added or used in the manual and/or automated modules of the inventive dispenser.

FIG. 1 illustrates one possible configuration of a manual module with the cover removed. This manual module includes a paper band 101 and a hand crank 102 to wind the paper band 101 into a coil of paper band 103 prepared for paper band dispensing cycles of the machine. The hand crank 102 and its winding hub may also be referred to as a manual unicharger. The coil of paper band 103 is complete once it has enough paper band for one turn up. In some examples, the device may include a cutter mechanism 104. The module includes a manual machine track inlet 105 to feed paper band 101, a nip cylinder 107, and manual drive wheel 109. In this example, the module includes a view port 106 to position the end of the paper band in the track. This manual module further includes another hand crank 108 to actuate the manual drive wheel 109.

In some embodiments, the manual module may be used to perform the turn up process for changing paper web spools. For example, referring again to FIG. 1, an operator may apply a length of adhesive to the end of the paper band 101 and feed it into the machine track inlet 105. The paper band 101 may be advanced until it is visible at the view port 106. The operator may next activate the nip cylinder 107 while turning the hand crank 108. The turning of the hand crank 108 may cause the manual drive wheel 109 to turn until the paper band is loaded in the staging position in the cross machine track (not present in the illustration). When the empty spool is lowered onto the paper in the paper machine, an operator may feed the paper band into the nip between the empty spool and the drum, which initiates the turn up. In a timed sequence, a brake (not shown) may be engaged to apply the necessary tension to effect the turn up by tearing the paper and binding it to the new spool. The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a pneumatic feed mechanism in the manual dispenser module is triggered by the paper machine and in turn actuates the brake. In some embodiments, an over-running clutch between the hand crank and the drive wheel may prevent the handle from spinning rapidly in a hazardous manner during a turn-up. Prior to the next desired turn-up, an operator may reset switches on the control panel to prepare the system for the next turn-up cycle.

Figure 2:
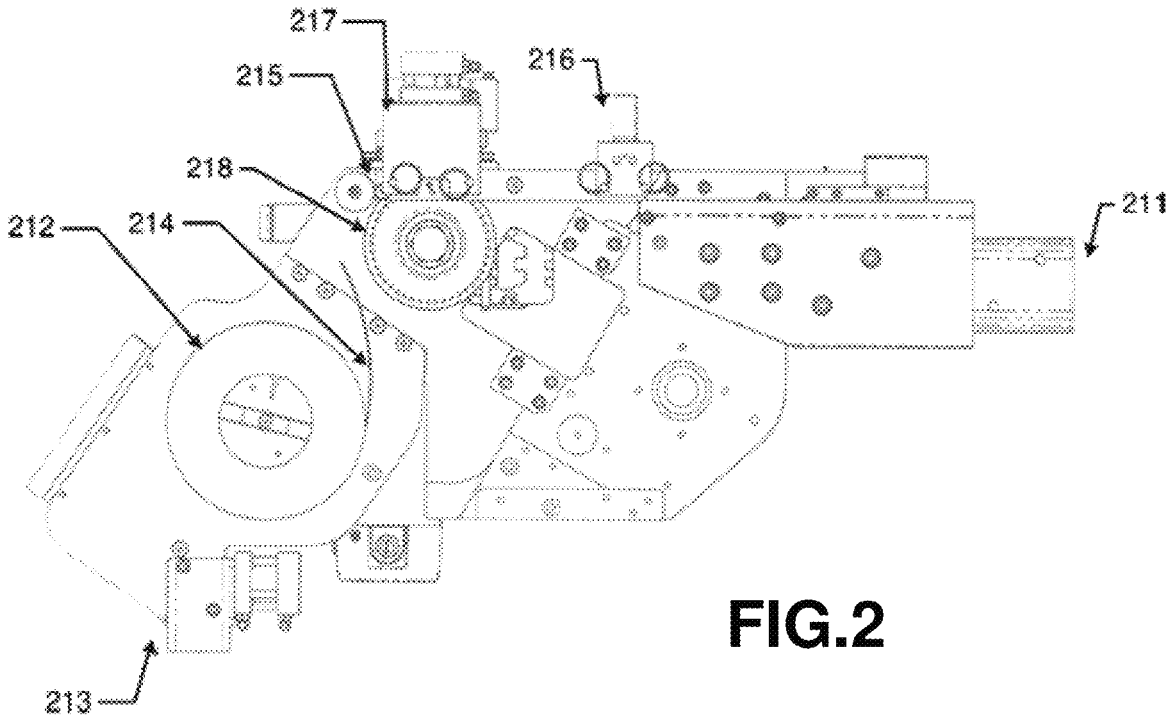
FIG. 2 illustrates an automated tape dispensing module of a transfer tape dispenser according to an embodiment of the invention. Such an automated tape dispensing module may be combined, in some embodiments, with the manual tape dispensing module of FIG. 1.

FIG. 2 illustrates one possible configuration of an automated module with the cover removed. As may be observed, the automated module is designed to be modular and can readily be integrated with another tape dispensing module such as the manual module of FIG. 1. In this embodiment, the automated module includes a cross machine beam adapter 211 which may be used to support the apparatus. In this module, the paper band stock is coiled into the spool of paper band 212 via an automated unicharger. This automated module further includes a cutter mechanism 213. The end of the paper band 214 after cutting with the cutter mechanism 213 is shown; this is the portion to which adhesive may be applied by an operator. After applying the adhesive, the paper band is fed into the machine track inlet 215 until it reaches a retractable stop 216 to indicate the correct starting position. The module further includes nip cylinder 217. The paper band may be pushed by the automated drive wheel 218, which may be powered by a motor (not shown) and may rotate to push the paper band through the cross-machine track to a staging position (not shown).

In some embodiments, the automated module may be used to perform the turn up process for changing paper web spools. In performing the automated turn-up, in some embodiments, the automated module may act as follows (referring again to FIG. 2). A paper band may be inserted into a winding hub, and a motor may wind a coil 212 of paper band sufficient for one cycle of the machine. If so equipped, the cutter mechanism 213 may be cycled to cut the paper band. Otherwise, the operator may cut the paper band by hand. Sometime before the spool on the paper machine is full, the operator may apply a length of adhesive to the end of the paper band 214. Next, the operator may feed the paper band 214 into the machine track inlet 215 until it is stopped by the retractable stop 216. In some examples, at this point, the machine is put under automatic control and retracts the retractable stop 216. The machine then closes the nip cylinder 217 and an automated drive wheel 218 may rotate to load the paper band through the cross-machine track to the staging position (not shown). When a signal is received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to affect the turn up by tearing the paper and binding it to the new spool. Finally, the system may be reset for the next turn-up cycle by, for example, pressing a sequencing button on a control panel.

Figure 3:
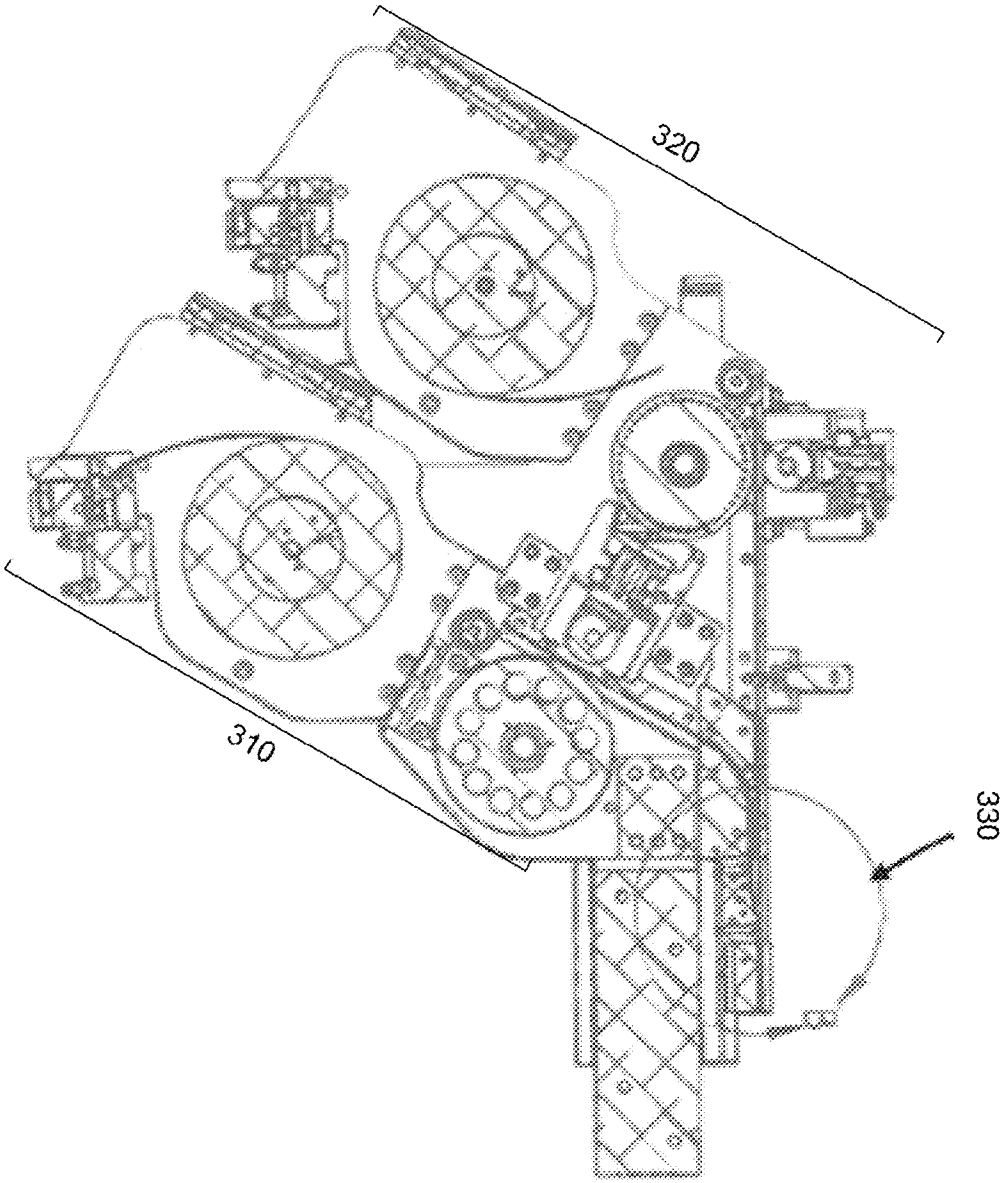
FIG. 3 illustrates a transfer tape dispenser having a manual tape dispensing module, an automated tape dispensing module, and a track adapter block.
Figure 4:
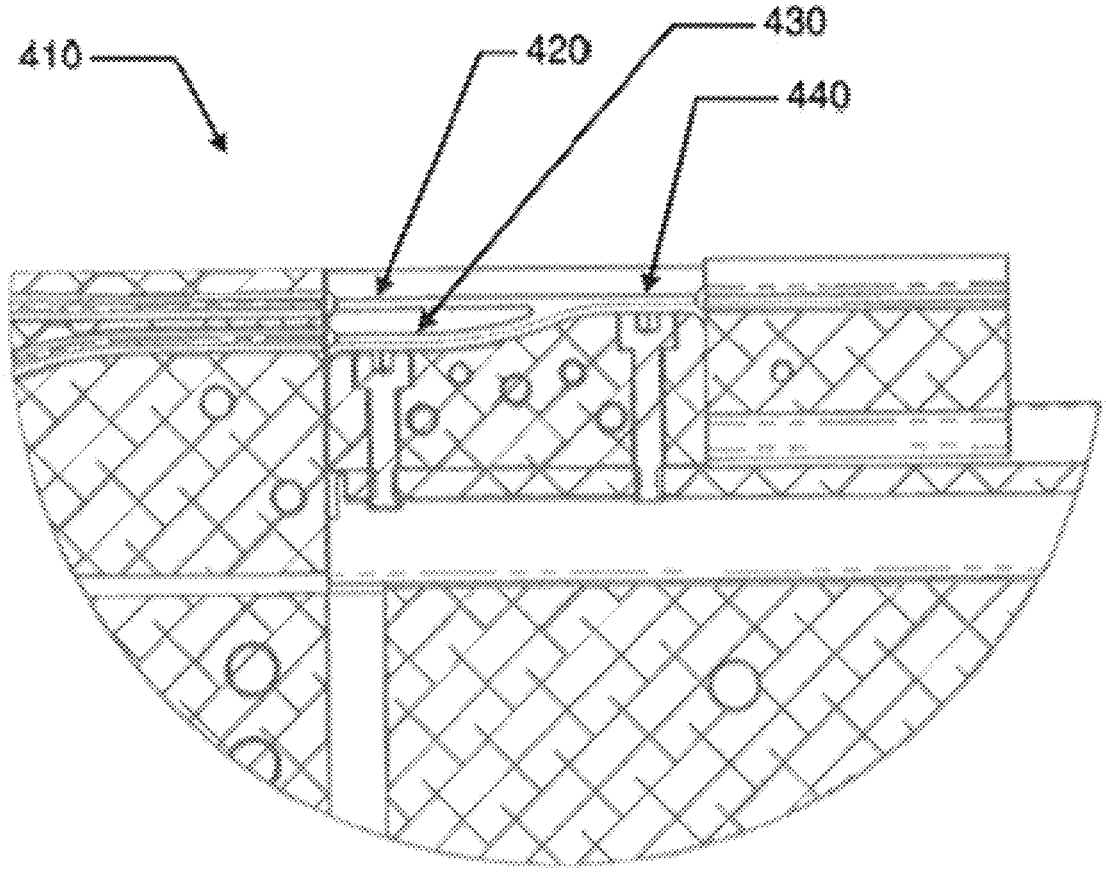
FIG. 4 illustrates a track adapter block according to an embodiment of the invention. This track adapter block merges the output tracks of the manual and automated tape dispensing modules to form a single output track.

Next, proceeding to FIG. 3, a side view of a combination tape dispenser with cover plates removed is illustrated. In this example, the manual module 310 and the automated module 320 are stacked and their outputs connect via a track adapter block 330 shown in the inset circle. Proceeding to FIG. 4, a track adapter block 410 is illustrated. The track adapter block 410 provides a confluence of the two outputs of the manual and automated modules (or the outputs of any two or more tape dispensing modules). Some applications of the machine are best served by a cross machine track with only one path through which the paper band is guided. A close examination of the track adapter block 410 in FIG. 4 reveals that the adapter block merges the lower manual module 430 band path with the upper automated 420 band path so both can use the same single output path 440 through the cross-machine track. Other configurations of the two tracks could be used in such embodiments provided that the two tracks merge into one track within the track adapter block 410.

Figure 5:
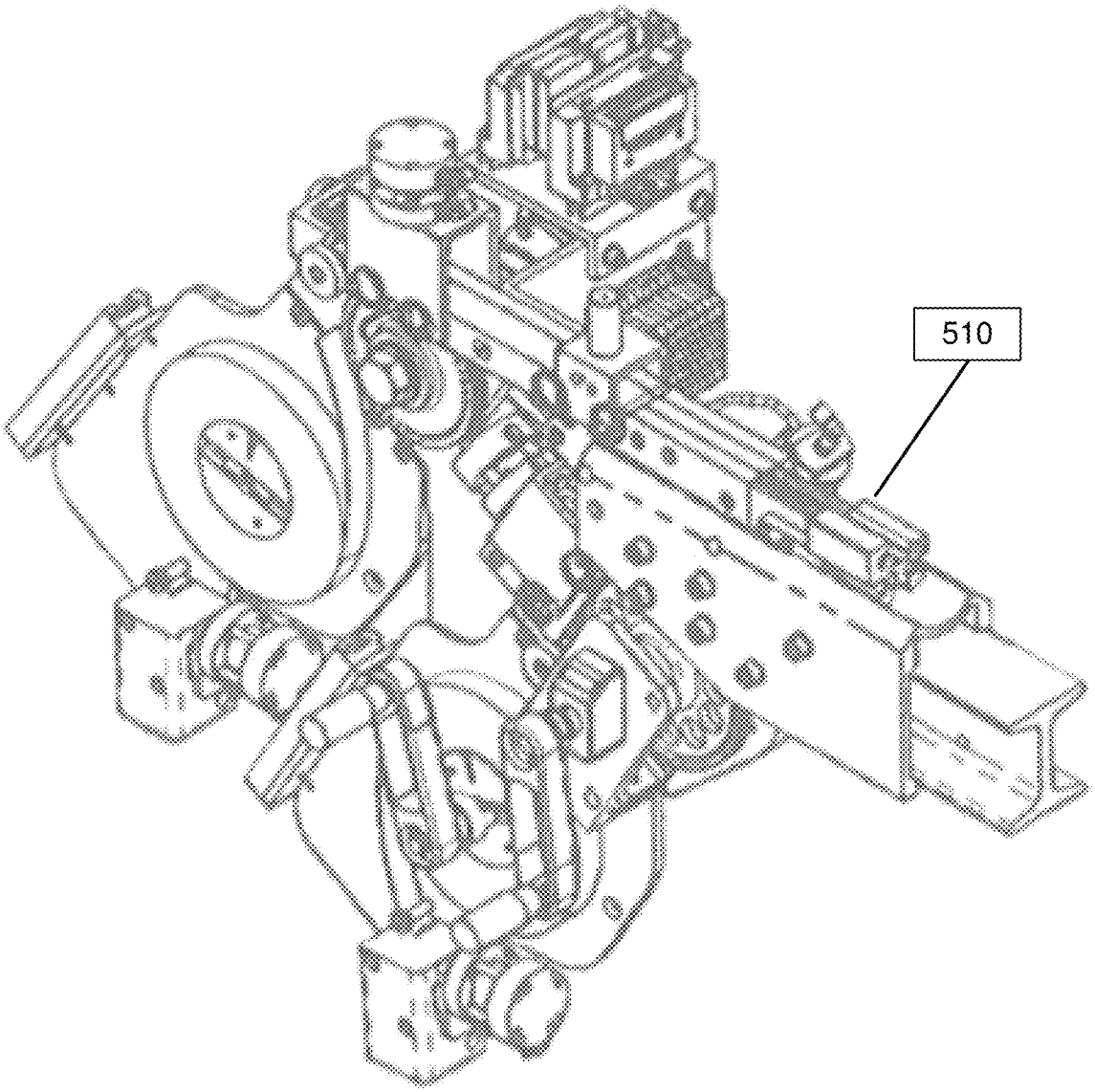
FIG. 5 illustrates an elevation perspective view of an assembled transfer tape dispenser according to an embodiment of the invention.

In some embodiments using this configuration, the secondary module may be staged with the paper tape element deployed as far as applying adhesive and pushing the paper band to the view port, while the primary module can be staged and ready to perform a turn up. In the event the primary unit fails to effect a turn-up, the secondary unit can be employed quickly to feed the paper band across the paper machine and inserted into the nip point (so long as the primary paper band has been removed from the track by the nip or by the operator). In FIG. 5, an elevation perspective view of a combination dispenser with a track adapter block 510 is illustrated.

Figure 6:
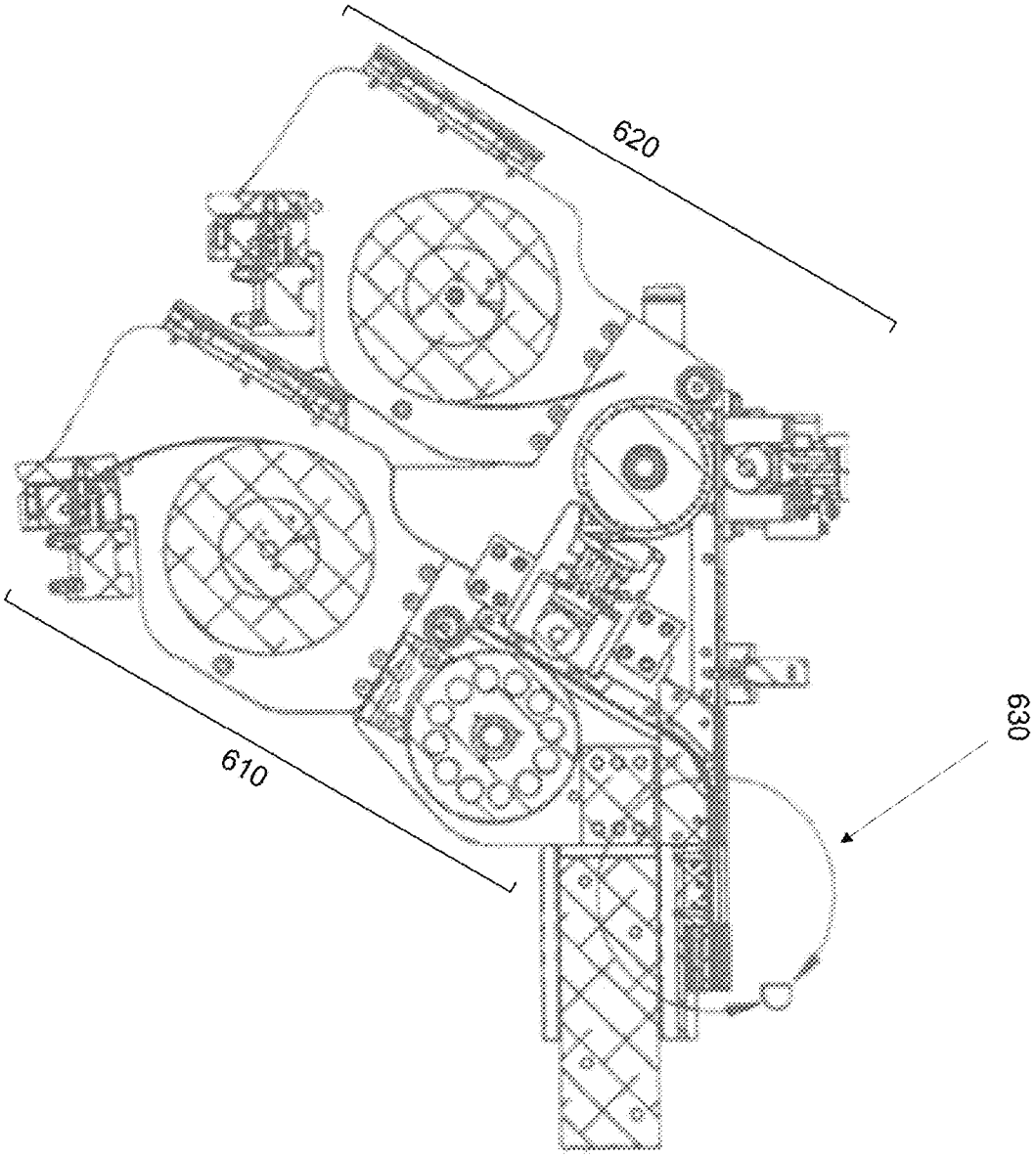
FIG. 6 illustrates a transfer tape dispenser having a manual tape dispensing module, an automated tape dispensing module, and a track adapter block.
Figure 7:
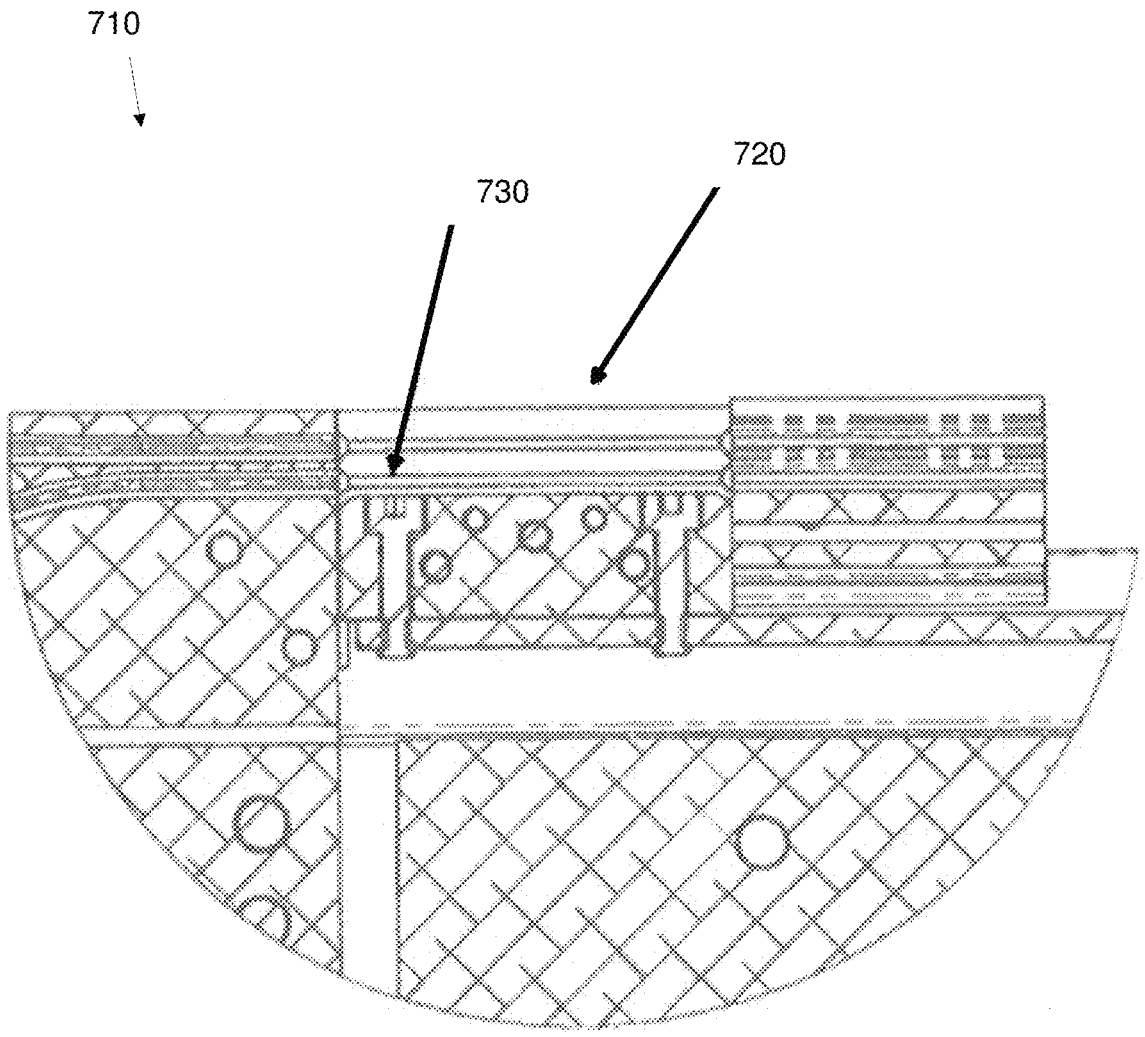
FIG. 7 illustrates a track adapter block according to an embodiment of the invention. In this track adapter block, the manual and automated tape dispensing modules have separate output tracks, in this case, in an over/under configuration.

In other instances, the operations may be better served by a cross machine track with two paths for the paper band. This may allow both the automated and manual modules to be fully staged simultaneously, with paper band fed across the paper machine. Such staging may significantly reduce recovery time after a missed turn up. Proceeding to FIG. 6, a combination turn-up tape dispenser that includes a manual module 610 and an automated module 620 is illustrated with another track adapter block 630. In FIG. 7, a dual path track adapter block 710 is illustrated. The different configuration, which may be called a stacked configuration, or an over/under configuration, may, in some cases, have substantially parallel paths as shown. The lower manual track 730 is parallel to and beneath the upper automated track 720. In some cases, non-parallel, curving, and/or other configurations could be used provided that each module has a separate track for its paper tape.

In tape dispensing apparatus that include primary and secondary tape dispensing modules, many functions may be performed without one or more of the modules being in place. In some examples, as have been described, the entire primary tape dispensing module of the apparatus can be removed for servicing and/or replacement in such a manner that it does not compromise the function of the secondary tape dispensing modules and therefore the functioning of the apparatus. Likewise, the entire secondary tape dispensing modules of the apparatus can be removed for servicing and/or replacement in such a manner that it does not compromise the function of primary tape dispensing module, and therefore the functioning of the apparatus. The same can be said regarding the components of each of the modules. The removal of one, some, or all of the secondary tape dispensing modules components can be effected without compromising the operation of the primary tape dispensing module. Likewise, the removal of one, some, or all of the primary tape dispensing module components can be effected without compromising the operation of the secondary tape dispensing modules. Furthermore, due to this modularity, additional features (upgrades) to the primary tape dispensing module may be added without compromising the operation of the secondary tape dispensing modules, and additional features (upgrades) to the secondary tape dispensing modules may be added without compromising the operation of the primary tape dispensing module. This modularity and adaptability allow the apparatus to 1) fit a wide range of budget considerations, 2) be upgraded in the field, and 3) be serviced and repaired without compromising ongoing mill operations.

As described above, the manual module, the automated module, and the combined dispenser may have a number of different configurations. FIGS. 8-24B show various permutations of manual, automated, and combined dispensers according to embodiments of the invention. The below chart summarizes some of the differences between each permutation. One skilled in the art will understand that many more permutations are possible; this list is meant to be illustrative and not exhaustive.

| FIGS. | Automated and/or Manual Module | Representative Module Elements |
|---|---|---|
| 8-9 | Manual | Reservoir, view port, drive wheel, nip cylinder |
| 10-11 | Manual | Manual unicharger, view port, drive wheel, nip cylinder |
| 12-13 | Manual | Manual unicharger, cutter, view port, drive wheel, nip cylinder |
| 14-15 | Manual | Manual unicharger, cutter, view port, nip cylinder, counter |
| 16A-16B | Automated | Automated unicharger, view port, drive wheel, nip cylinder |
| 17A-17B | Automated | Automated unicharger, cutter, view port, drive wheel, nip cylinder |
| 18A-18B | Automated | Automated unicharger, cutter, retractable stop, drive wheel, nip cylinder |
| 19A-19B | Automated/ Manual | Manual: reservoir, view port, drive wheel, nip cylinder; Automated: automated unicharger, drive wheel, nip cylinder |
| 20A-20B | Automated/ Manual | Manual: reservoir, retractable stop, drive wheel, nip cylinder; Automated: automated unicharger, cutter, drive wheel, nip cylinder |
| 21A-21B | Automated/ Manual | Manual: reservoir, retractable stop, drive wheel, nip cylinder; Automated: automatic unicharger, cutter, drive wheel, nip cylinder |
| 22A-22B | Automated/ Manual | Manual: reservoir, retractable stop, drive wheel, nip cylinder, counter; Automated: automated unicharger, cutter, drive wheel, nip cylinder |
| 23A-23B | Automated/ Manual | Manual: manual unicharger, retractable stop, drive wheel, nip cylinder counter; Automated: automatic unicharger, cutter, drive wheel, nip cylinder |
| 24A-24B | Automated/ Manual | Manual: manual unicharger, cutter, tractable stop, drive wheel, nip cylinder, counter; Automated: automatic unicharger, cutter, drive wheel, nip cylinder |

Figure 8:
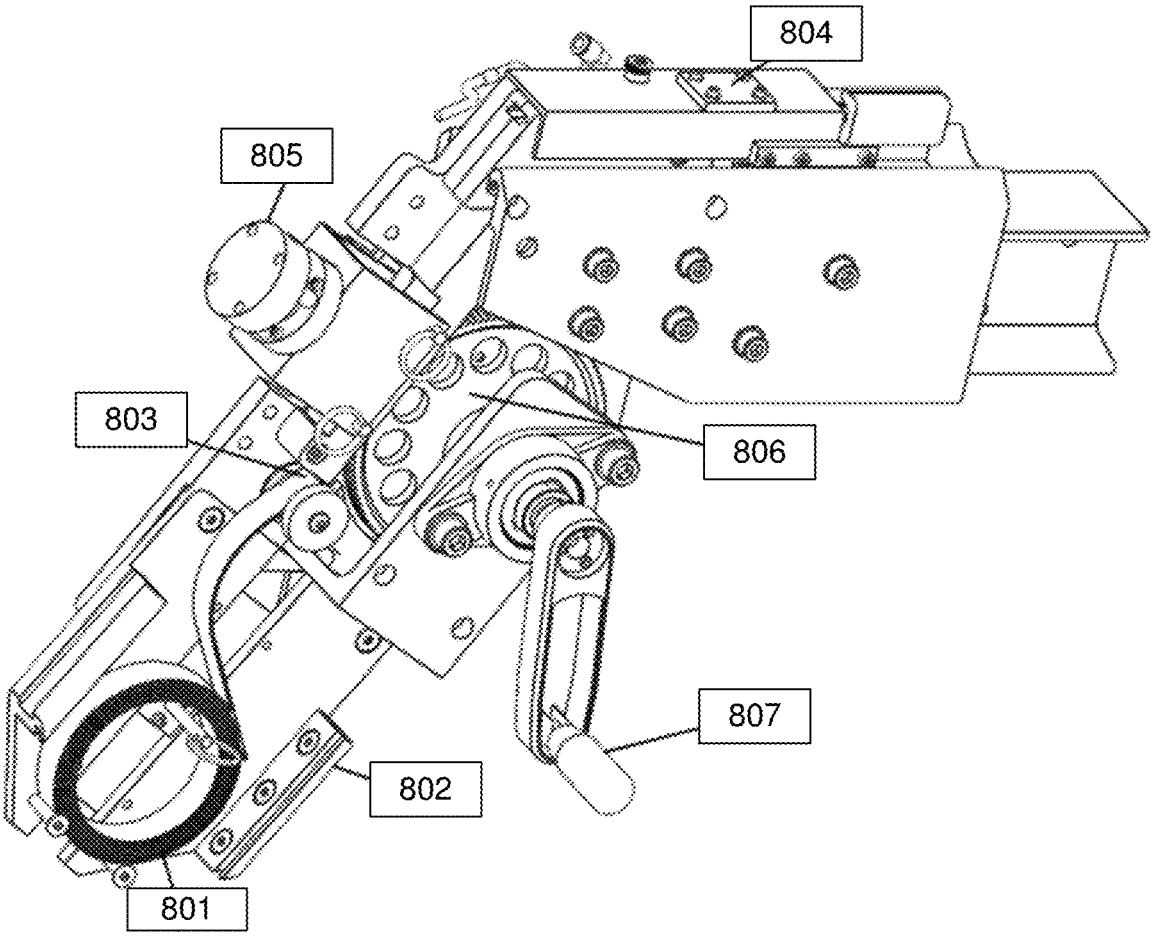
FIG. 8 illustrates a side perspective view of a manual tape dispensing module according to a particular embodiment of the invention.
Figure 9:
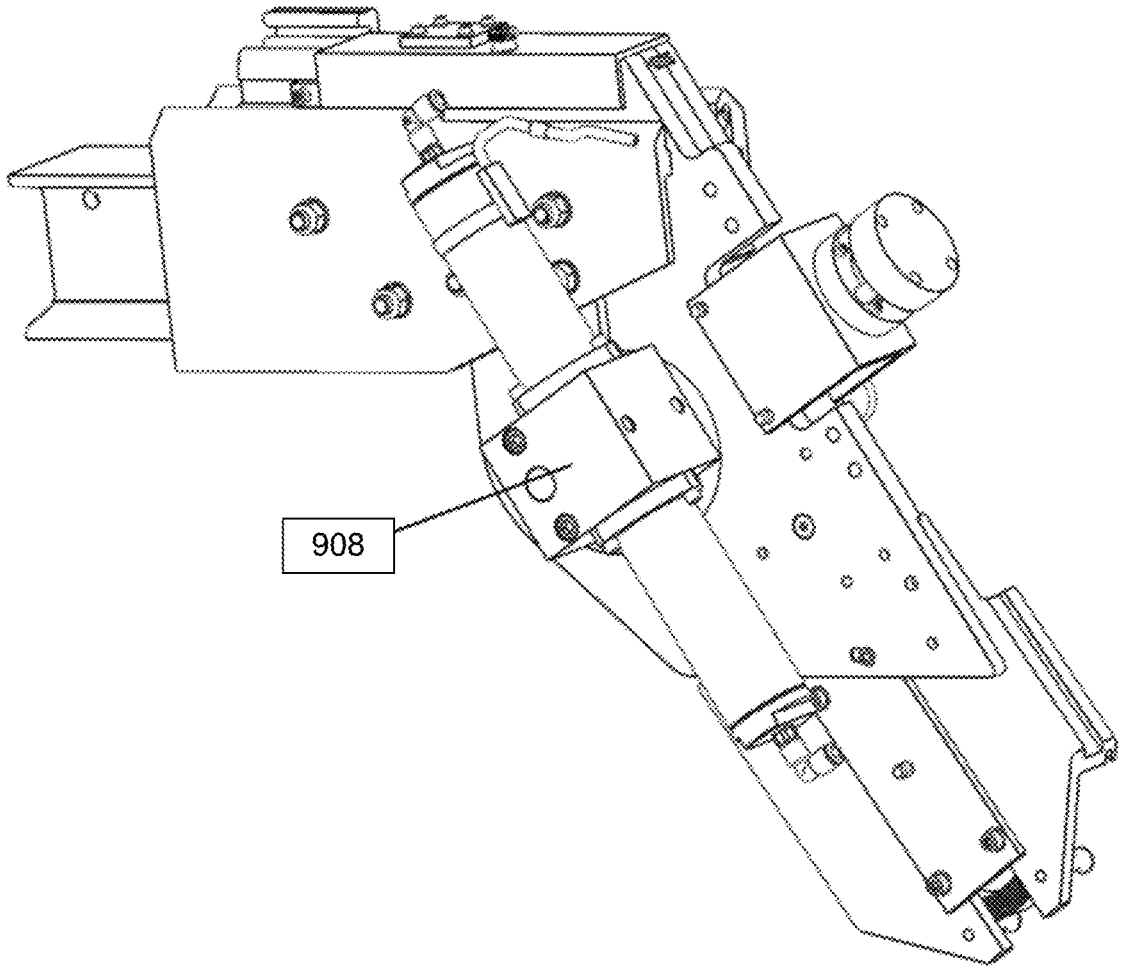
FIG. 9 illustrates a different side perspective view of the manual tape dispensing module in FIG. 8.

In FIGS. 8 and 9, a manual module (cover plates removed) with reservoir and hand-cranked drive wheel is illustrated. Paper band 801 may be hand-coiled separately from the apparatus and placed into a reservoir 802 (outer portion of reservoir not shown due to removal of cover plates). Alternatively, a paper band coil created by a unicharger in another module, or a single use tape dispenser box, described in further detail below, could be secured in the reservoir 802. Adhesive may be applied to the free end of paper band 801. An operator may push paper band 801 as far as view port 804 to establish a reliable starting point for subsequent length-based functions. Nip cylinder 805 may be enabled by a switch on a control panel to pinch paper band 801 against drive wheel 806, which may allow paper band 801 to be advanced reliably. An operator may turn the drive wheel 806 with crank 807 to push the paper band 801 across the paper machine through a cross-machine track, until the end of the paper band 801 is desirably staged for a subsequent turn-up. To perform the turn-up, the operator may activate feed mechanism 908 (See FIG. 9) by actuating a switch on a control panel that causes drive wheel 806 to push paper band 801 into a nip point between the drum and empty spool. Alternatively, the paper web turn-up system may initiate turn-up automatically based on a signal from the paper machine.

Figure 10:
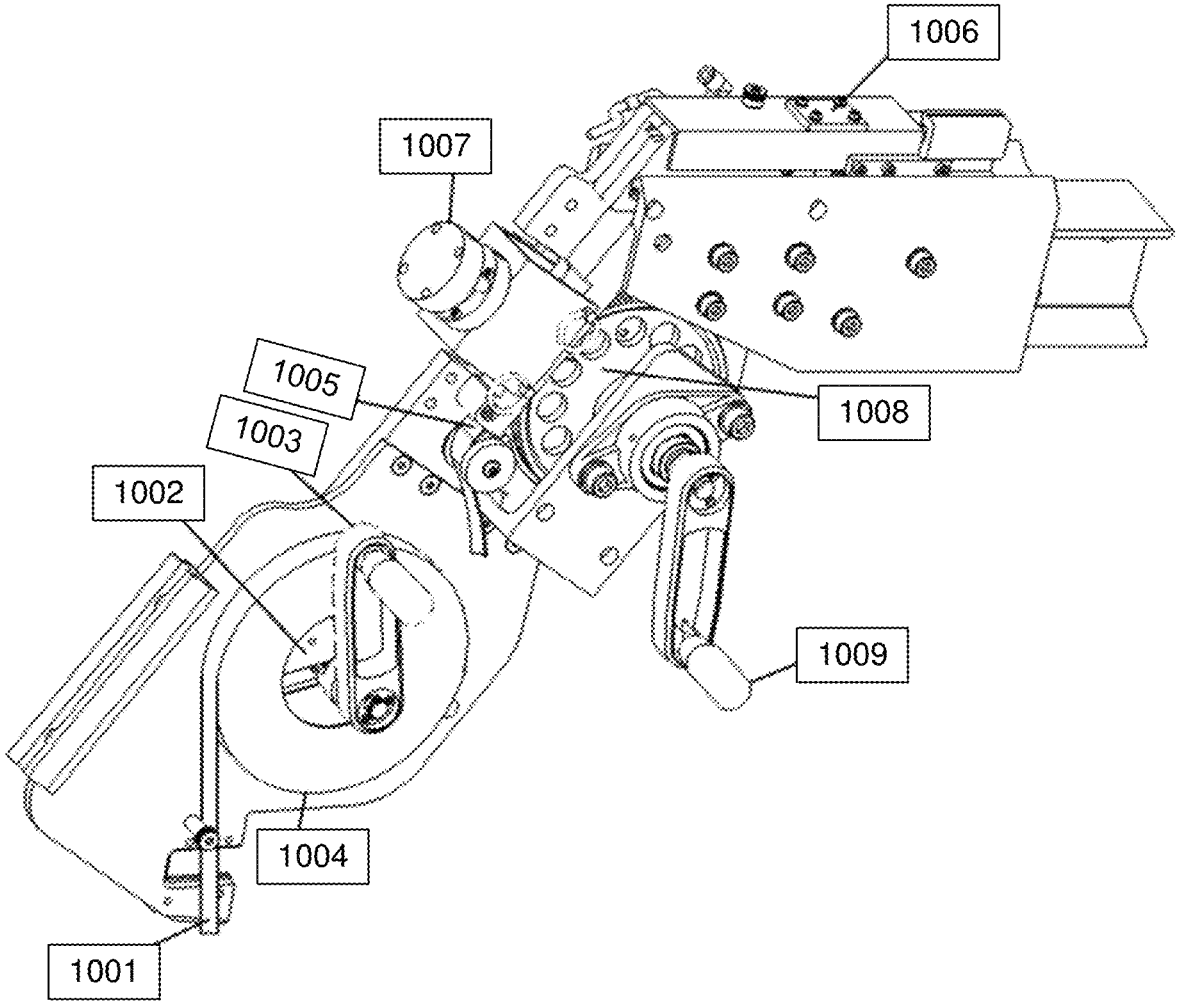
FIG. 10 illustrates a side perspective view of a manual tape dispensing module according to a particular embodiment of the invention.
Figure 11:
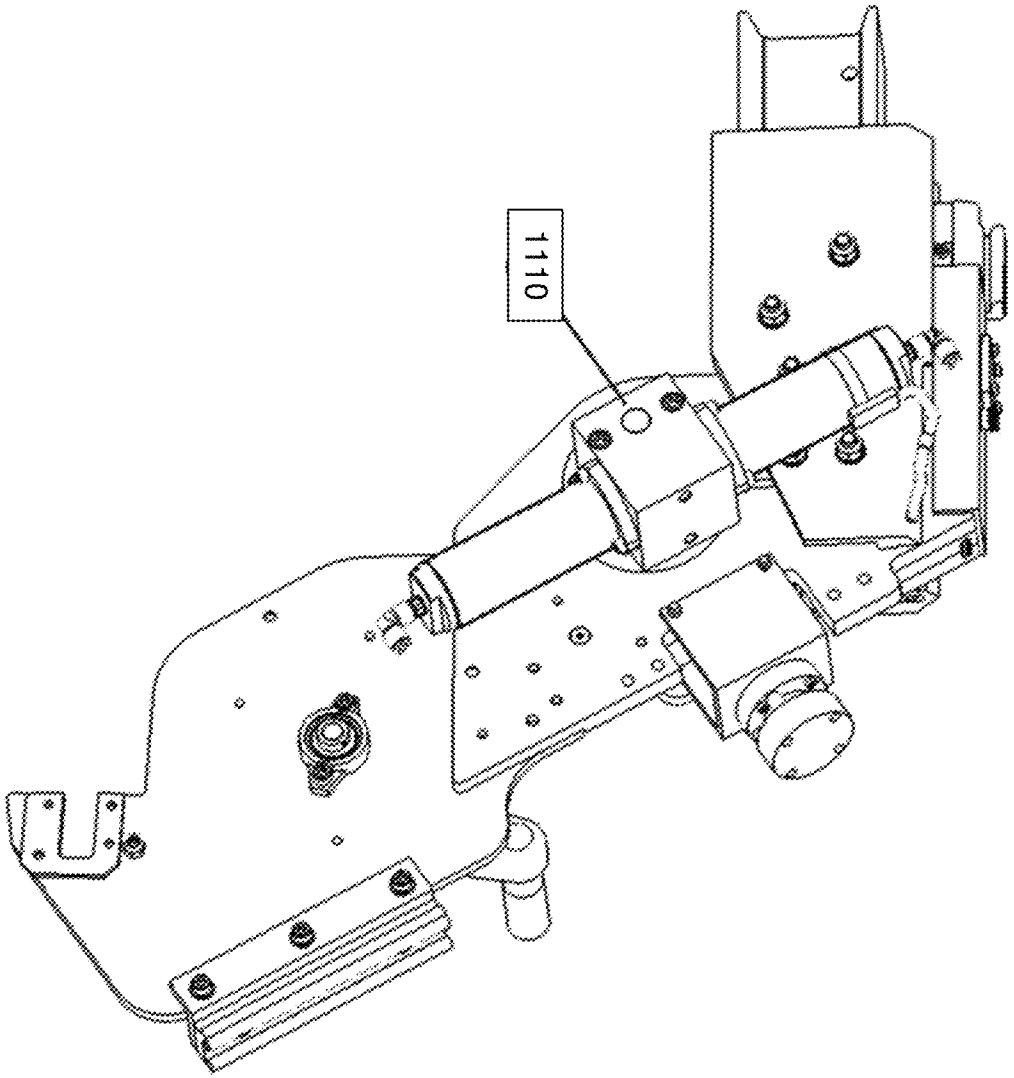
FIG. 11 illustrates a different side perspective view of the manual tape dispensing module in FIG. 10.

In FIGS. 10 and 11, aspects of a manual module with an optional unicharger and aspects of its use are illustrated. The end of paper band 1001 may be inserted into a slot in winding hub 1002 of the manual unicharger. Hand crank 1003 may be engaged into the winding hub and turned to wind a desired length of paper band into coil 1004; the paper band 1001 may then be cut with a hand tool. The unicharger is thus charged with enough length of paper tape for one turn up. In some embodiments, a length of adhesive may be applied to the free end of paper band 1001. The paper band 1001 may then be inserted into the module's track through an inlet 1005. An operator may then push the paper band a length, such as to view port 1006, in the track to establish a reliable starting point for subsequent length-based functions. An operator may then enable a nip cylinder 1007 by a switch on a control panel to pinch paper band 1001 against drive wheel 1008. Drive wheel 1008 may be turned with crank 1009 to push paper band 1001 across the paper machine through the cross-machine track until the end is properly staged for a subsequent turn-up. When the operator desires to perform a turn-up, the operator may activate feed mechanism 1110 (See FIG. 11) by actuating a switch on a control panel that causes drive wheel 1008 to push paper band 1001 into the nip point between the drum and empty spool. In a timed sequence, a brake (not shown) may be engaged to apply the necessary tension to effect the turn up by tearing the paper and binding it to the new spool. The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake.

Figure 12:
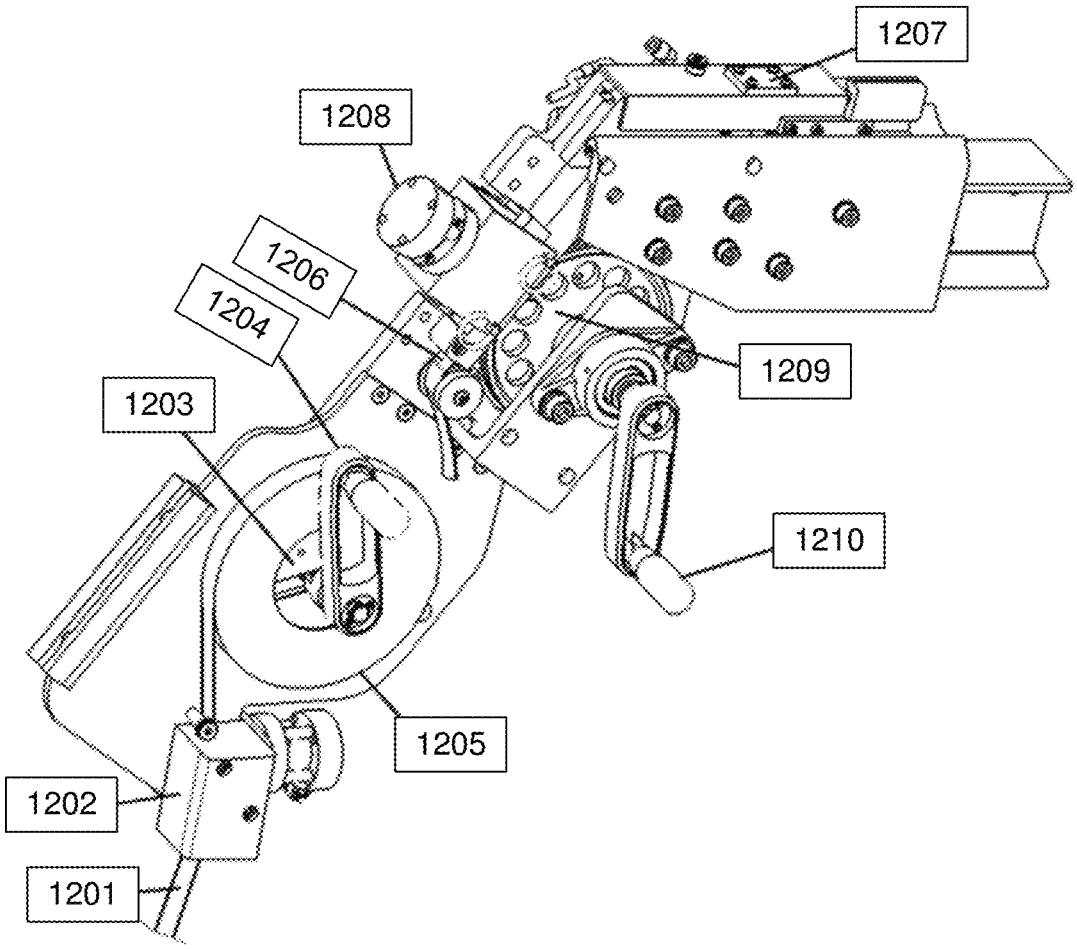
FIG. 12 illustrates a side perspective view of a manual tape dispensing module according to a particular embodiment of the invention.
Figure 13:
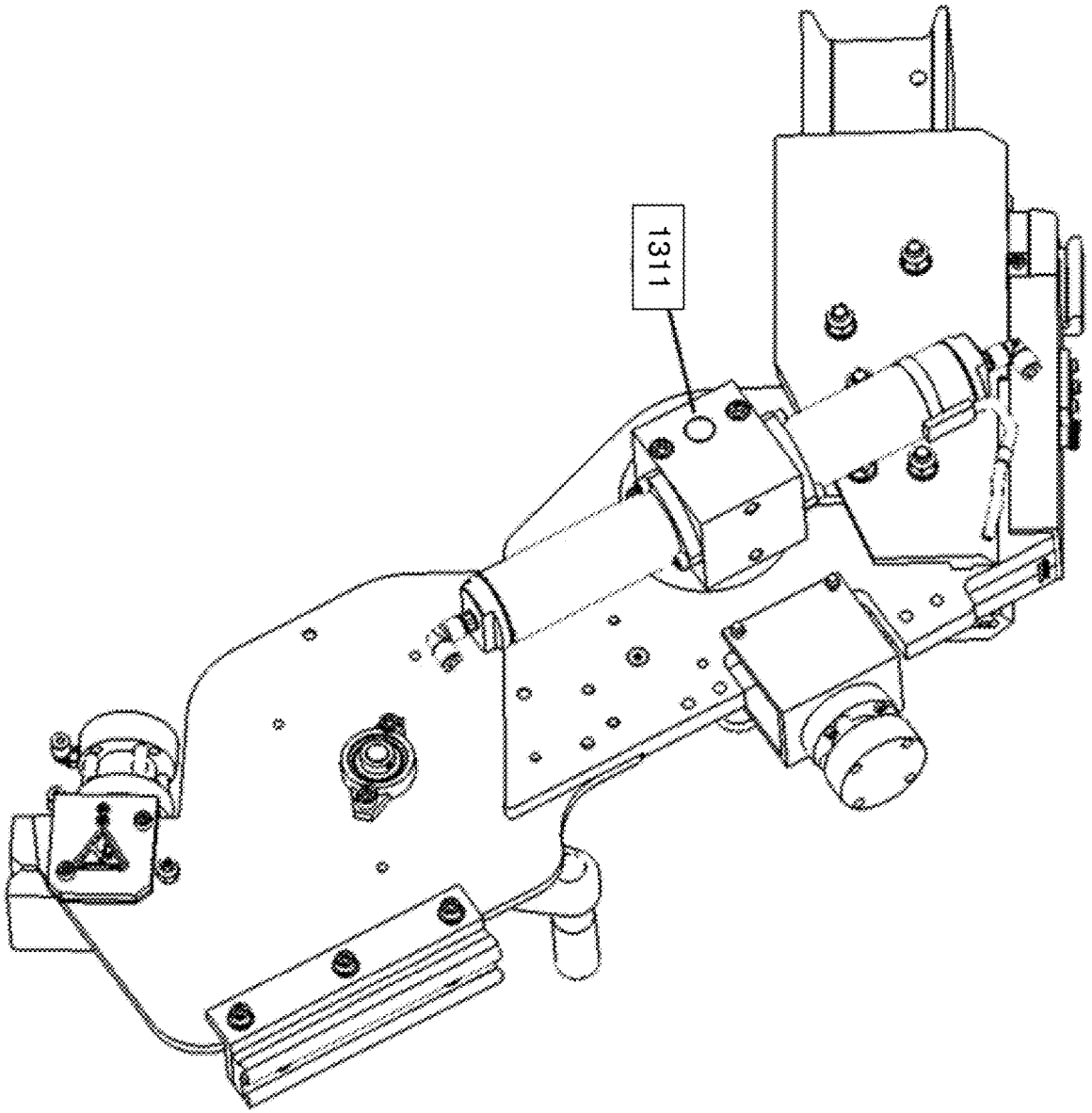
FIG. 13 illustrates a different side perspective view of the manual tape dispensing module in FIG. 12.

Another optional feature is a cutter device. In FIGS. 12 and 13, aspects of a manual module with a mechanical cutter and a manual unicharger are illustrated. Paper band 1201 may be threaded through cutting mechanism 1202 and inserted into in winding hub 1203. Hand crank 1204 may be engaged into the winding hub 1203 of the unicharger and turned to wind a desired length of paper band 1201 into coil 1205, and the cutting mechanism 1202 may be cycled by a switch on a control panel. A length of adhesive may be applied to a free end of paper band 1201. The paper band 1201 may then be inserted into the manual module's track through inlet 1206. Paper band 1201 may be pushed back as far as view port 1207 in the track to establish a reliable starting point for subsequent length-based functions. An operator may enable nip cylinder 1208 by a switch on a control panel to pinch the paper band against drive wheel 1209. Drive wheel 1209 may then be turned by crank 1210 to push the paper band across the paper machine through the cross-machine track until the end is properly staged for a subsequent turn-up. To perform a turn-up, feed mechanism 1311 (See FIG. 13) may be activated by a switch on the control panel that causes drive wheel 1209 to push the paper band 1201 into the nip point between the drum and empty spool. In a timed sequence, a brake (not shown) may be engaged to apply the necessary tension to affect the turn up by tearing the paper and binding it to the new spool. The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake.

Figure 14:
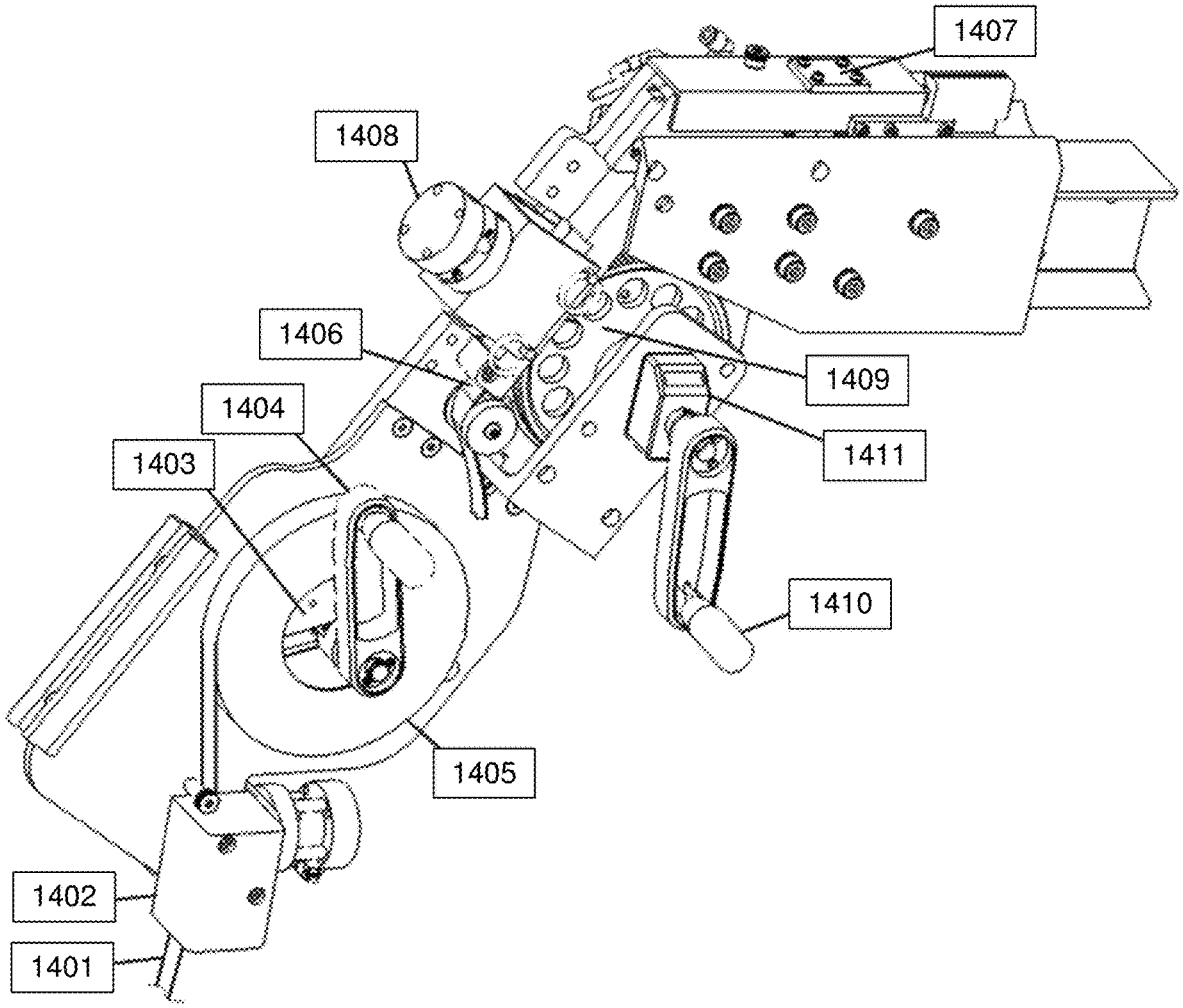
FIG. 14 illustrates a side perspective view of a manual tape dispensing module according to a particular embodiment of the invention.
Figure 15:
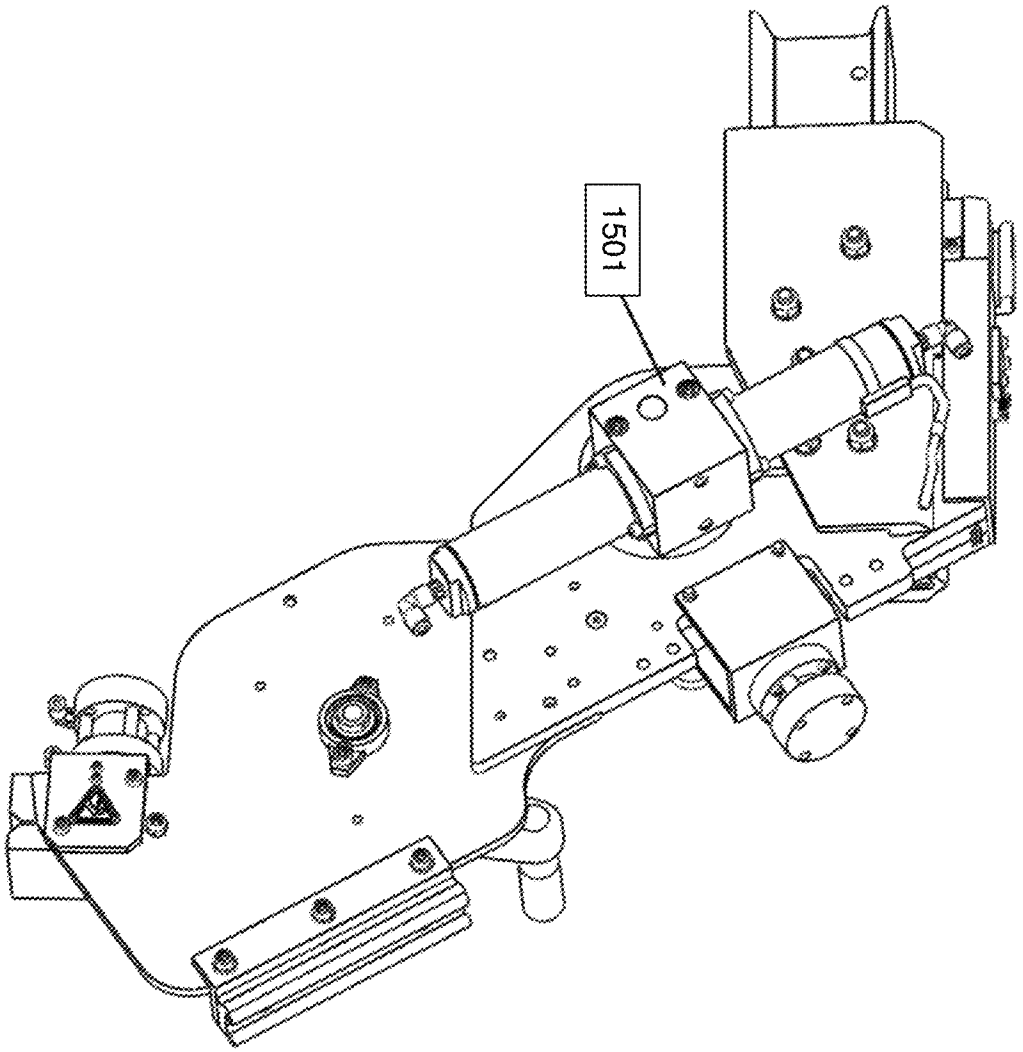
FIG. 15 illustrates a different side perspective view of the manual tape dispensing module in FIG. 14.

Another optional feature in the manual module is a mechanical counter. FIGS. 14 and 15 show an example of a manual module with a hand-powered winder, a cutting mechanism, a hand-cranked drive wheel, and a mechanical counter. Paper band 1401 is threaded through cutting mechanism 1402; the end is inserted into a slot in winding hub 1403 of a manual unicharger. Hand crank 1404 may then be engaged into the winding hub 1403 and turned to wind a desired length of paper band into coil 1405; thereafter, the cutting mechanism 1402 may be cycled by a switch on a control panel. A length of adhesive may be applied to the free end of paper band 1401. The paper band may be inserted into the module's track through inlet 1406. The operator may then push the paper band 1401 as far as view port 1407 in the track to establish a reliable starting point for subsequent length-based functions. The operator may then enable a nip cylinder 1408, such as by a switch on a control panel, to pinch the paper band 1401 against drive wheel 1409. Crank 1410 may be operable to turn drive wheel 1409 to push the paper band 1401 across the paper machine through the cross-machine track until mechanical counter 1411 registers a prescribed length of paper tape staged for the subsequent turn-up. The operator may then activate feed mechanism 1501 (See FIG. 15), such as by actuating a switch on a control panel, to cause the drive wheel to push the paper band into the nip point between the drum and empty spool. In a timed sequence, a brake (not shown) may be engaged to apply the necessary tension to effect the turn up by tearing the paper and binding it to the new spool. The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake.

Figure 16A:
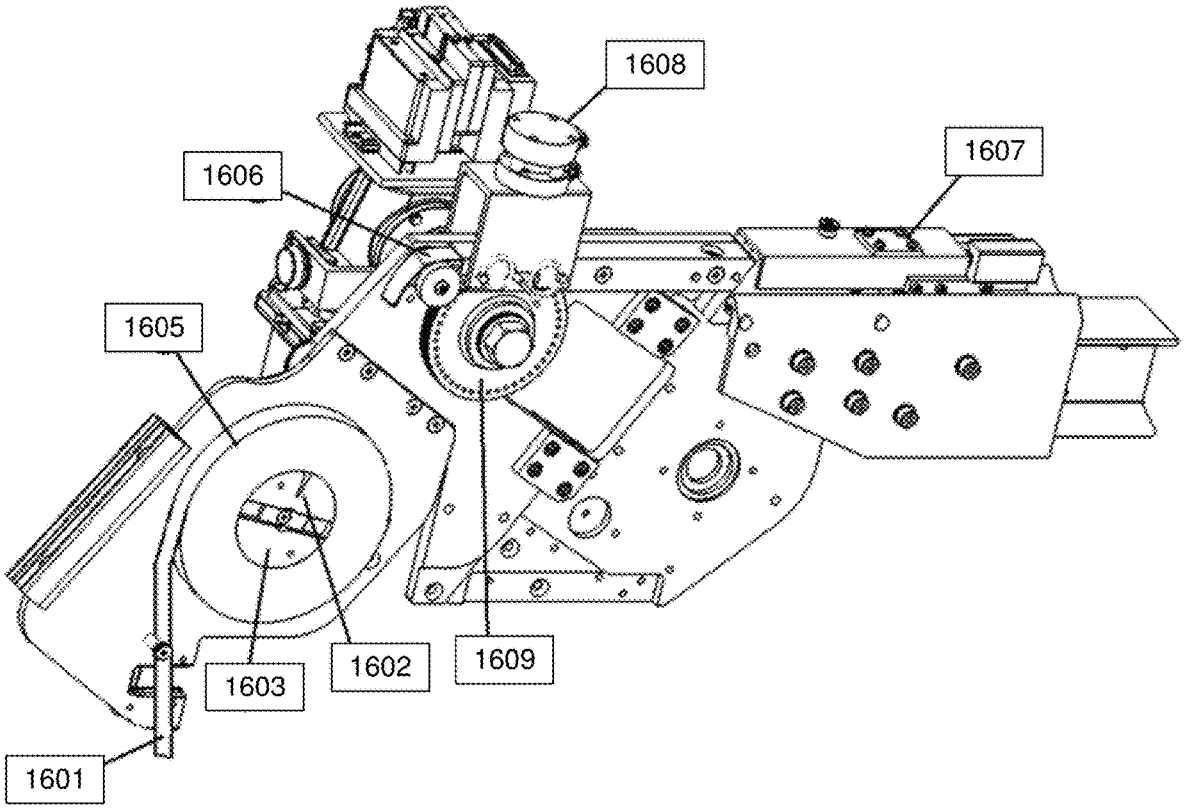
FIG. 16A illustrates a side perspective view of an automated tape dispensing module according to a particular embodiment of the invention.
Figure 16B:
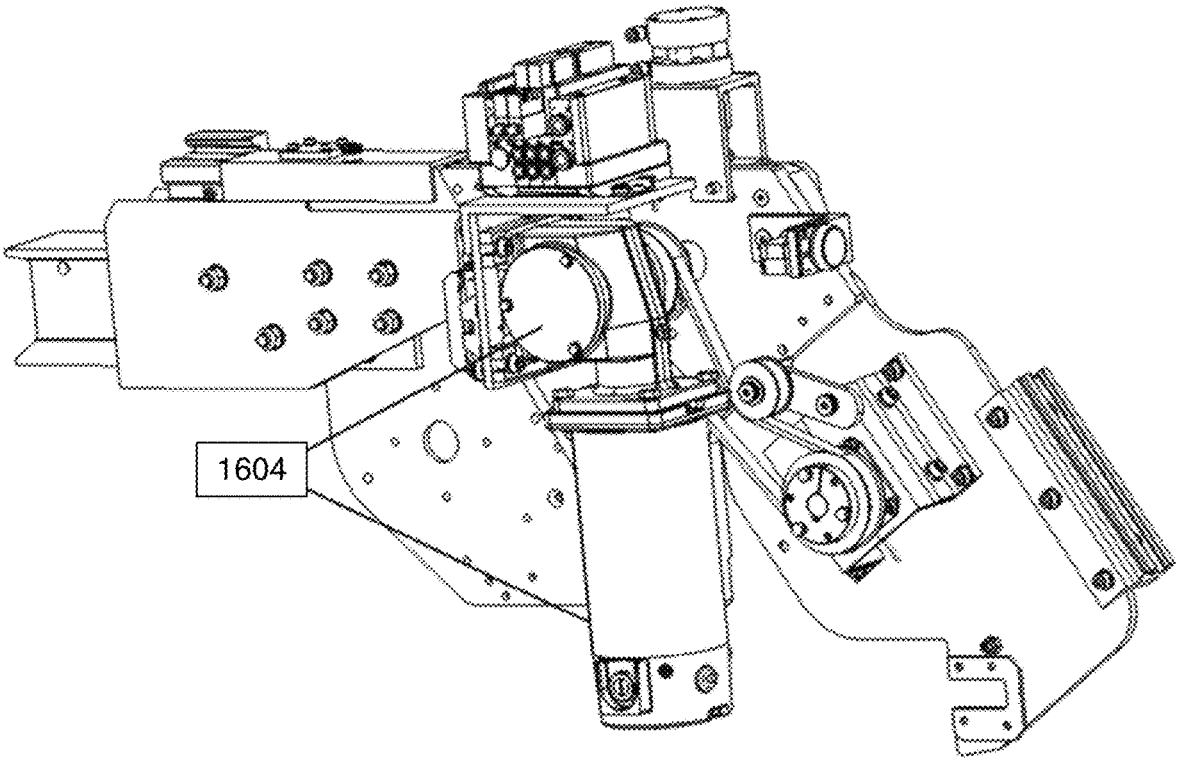
FIG. 16B illustrates a different side perspective view of the automated tape dispensing module in FIG. 16A.

The automated module may also have various optional components. While the automated module may use hand or manual spooled paper tape, or a single use tape dispensing box, in some embodiments, an automated unicharger may be included. In FIGS. 16A and 16B, an automated module with a powered winding hub and spool (an automated unicharger) and a powered drive wheel is illustrated. The end of a supply of paper band 1601 is inserted into a slot 1602 in a winding hub 1603 of the unicharger. Motor 1604 (See FIG. 16B) may be actuated by, for example, sequencing push-button on a control panel to wind a coil of paper band 1605 to a predetermined length. The coiled paper band 1605 may be cut from the supply of paper band 1601. An adhesive-treated end of the paper band may be inserted into the automated module's track by inlet 1606 and may be pushed as far as view port 1607 in the track to establish a reliable starting point for subsequent length-based functions. Nip cylinder 1608 may then be enabled by, for example, a sequencing push-button on a control panel to pinch the paper band against drive wheel 1609. When an operator desires to initiate a turn-up, a motor may be actuated that rotates drive wheel 1609. The motor may drive the unicharger and drive wheel independently by, for example, clutches. Drive wheel 1609 may push the paper band through the cross-machine track across a prescribed distance to a desired position in readiness for the turn-up. When a signal is received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to effectuate the turn up by tearing the paper and binding it to the new spool. Finally, the system may be reset for the next turn-up cycle by, for example, pressing a sequencing button on a control panel.

Figure 17A:
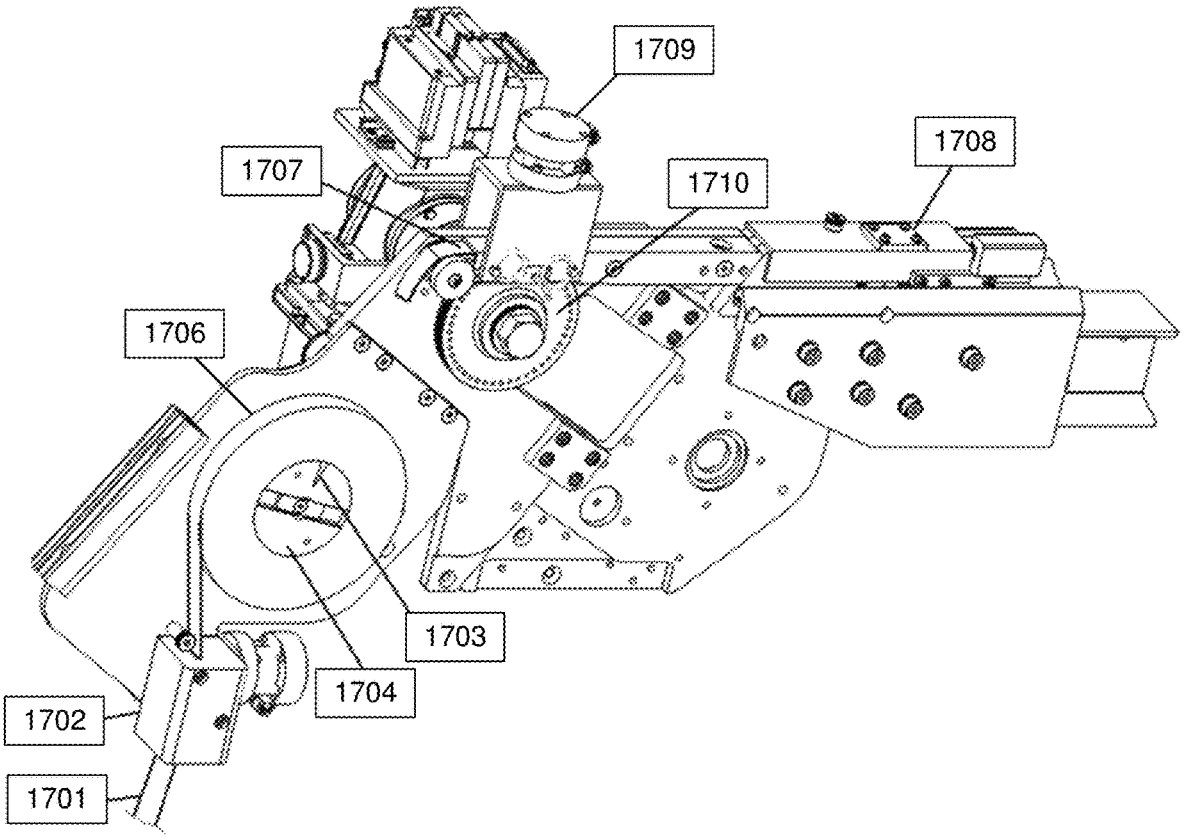
FIG. 17A illustrates a side perspective view of an automated tape dispensing module according to a particular embodiment of the invention.
Figure 17B:
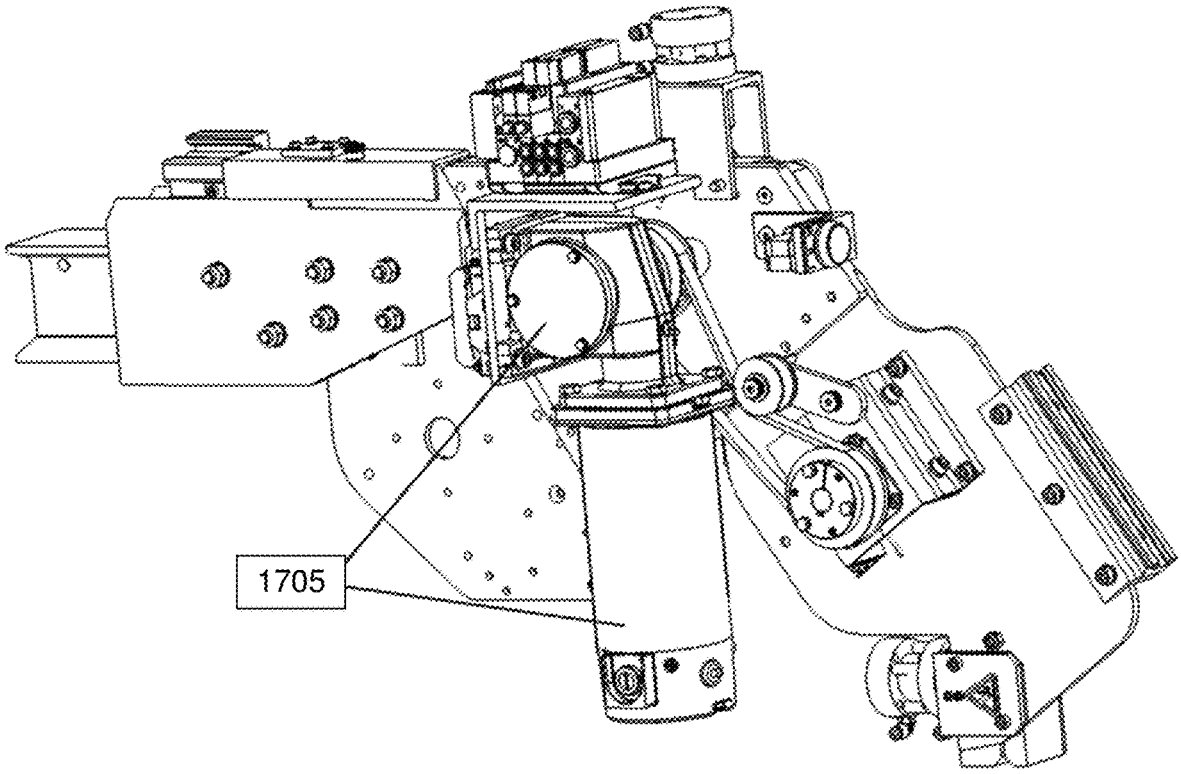
FIG. 17B illustrates a different side perspective view of the automated tape dispensing module in FIG. 17A.

The automated module may also optionally include a cutting device. In FIGS. 17A and 17B, an automated module with an automated unicharger, powered drive wheel, and cutting device is illustrated. A supply of paper band 1701 may be threaded through cutter 1702 into slot 1703 in winding hub 1704. A motor 1705 (See FIG. 17B) may then be actuated by, for example, sequencing push-button on a control panel to wind a coil of paper band 1706 to a predetermined length in the unicharger. The cutter 1702 may then cut the coil of paper band 1706 from the supply 1701 automatically. A length of adhesive may then be applied to the end of the wound paper band. This adhesive-treated end of the paper band may be inserted into the automated module's track by inlet 1707 and, in some embodiments, pushed as far as view port 1708 to establish a reliable starting point for subsequent length-based functions. Nip cylinder 1709 may then be enabled, in some embodiments by sequencing push-button on a control panel, to pinch the paper band against drive wheel 1710. To initiate a turn up, the motor 1705 may be actuated by, for example, sequencing push-button on a control panel. Motor 1705 may drive the winder and drive wheel independently by means of, for example, clutches. Drive wheel 1710 may push the paper band through a cross-machine track across a prescribed distance to a desired position to prepare for the turn-up. When a signal is received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to effect the turn up by tearing the paper and binding it to the new spool. Finally, the system may be reset for the next turn-up cycle by, for example, pressing a sequencing button on a control panel.

Figure 18A:
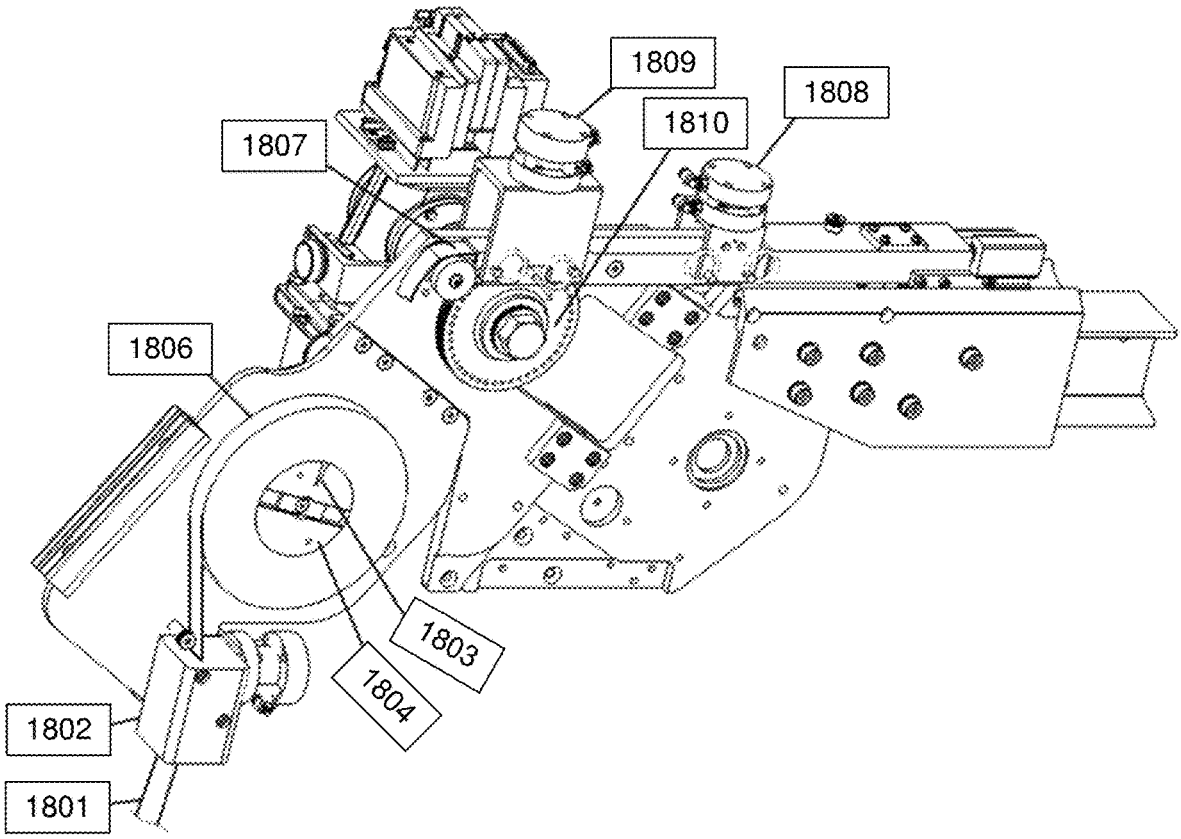
FIG. 18A illustrates a side perspective view of an automated tape dispensing module according to a particular embodiment of the invention.
Figure 18B:
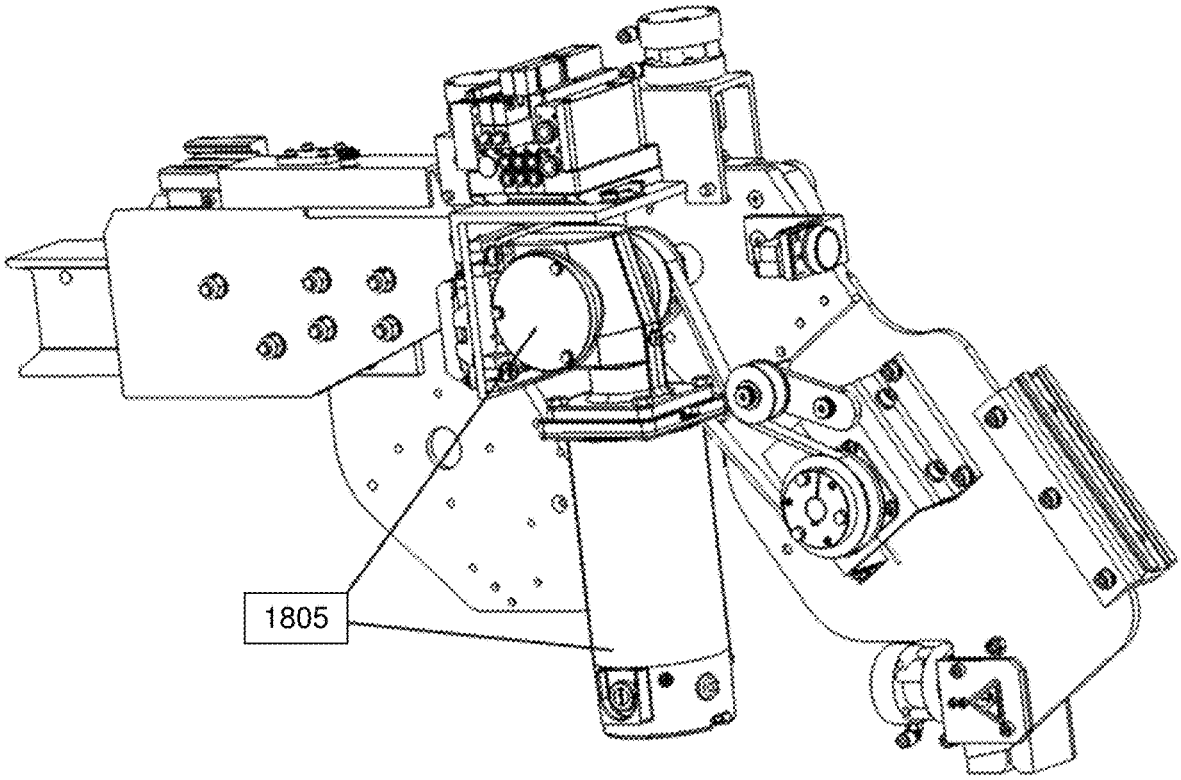
FIG. 18B illustrates a different side perspective view of the automated tape dispensing module in FIG. 18A.

Another optional feature is a retractable stop. In FIGS. 18A and 18B, an example of an automated module with an automated unicharger, powered drive wheel, and retractable stop is shown. The end of a supply of paper band 1801 may be threaded through cutter 1802 into slot 1803 in winding hub 1804 of the unicharger. A motor 1805 (See FIG. 18B) may then be actuated by, for example, sequencing push-button on a control panel to wind a coil of paper band 1806 to a predetermined length. The module may then cut the coil of paper band 1806 from the supply 1801 automatically. A length of adhesive may then be applied to the end of the wound paper band. This adhesive-treated end of the paper band may be inserted into the automated module's track by inlet 1807 and, in some embodiments, pushed as far as retractable stop 1808 to establish a reliable starting point for subsequent length-based functions. Nip cylinder 1809 may then be enabled, in some embodiments by sequencing push-button on a control panel, to pinch the paper band against drive wheel 1810. The retractable stop may be removed from the paper band path approximately simultaneously. To initiate a turn up, the motor 1805 may be actuated by, for example, sequencing push-button on a control panel. Motor

1805 may drive the unicharger and drive wheel independently by means of, for example, clutches. Drive wheel 1810 may rotate to push the paper band through a cross-machine track across a prescribed distance to a desired position to prepare for the turn-up. When a signal is received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to effect the turn up by tearing the paper and binding it to the new spool. Finally, the system may be reset for the next turn-up cycle by, for example, pressing a sequencing button on a control panel.

Figure 19A:
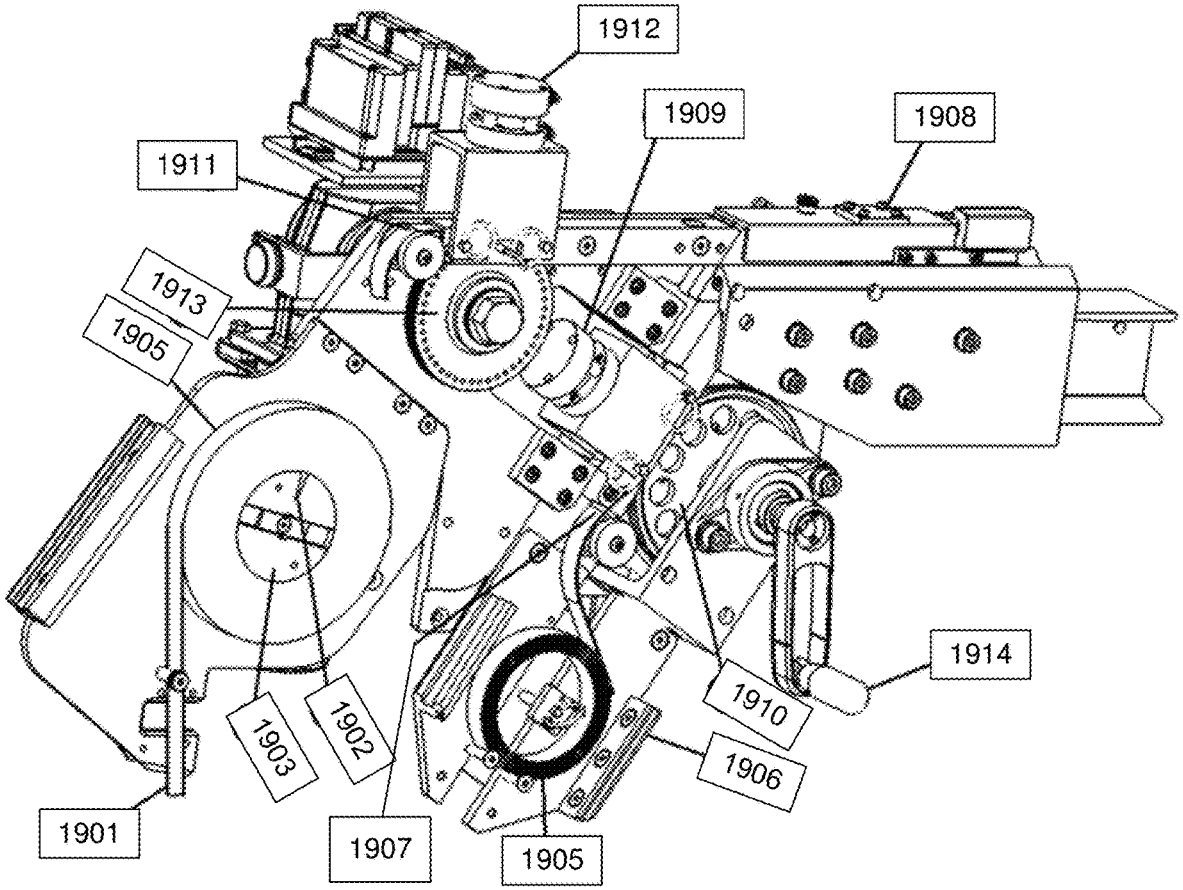
FIG. 19A illustrates a side perspective view of a transfer tape dispenser including an automated tape dispensing module and a manual tape dispensing module according to a particular embodiment of the invention.
Figure 19B:
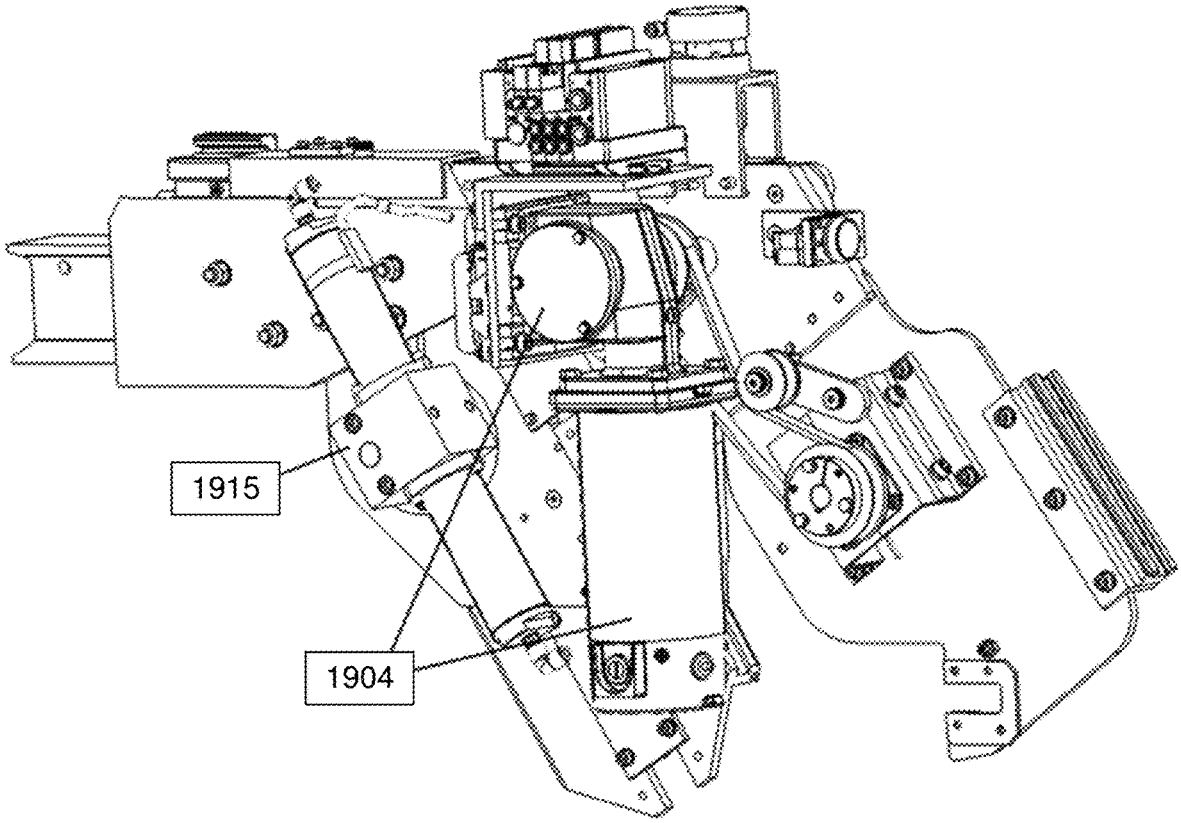
FIG. 19B illustrates a different side perspective view of the transfer tape dispenser in FIG. 19A.

As discussed above, different combinations of manual and automated modules may be used to form turn up tape dispensers of the invention. One example is an apparatus wherein the automated module includes a unicharger but the manual module does not. In such cases, the automated module may wind and create a paper tape spool that can be transferred to the manual module before winding an additional unicharger spool for the automated module. Of course, the manual and automated modules may instead use a single use paper tape dispensing box or a paper tape that has been spooled by another method known in the art. In FIGS. 19A and 19B, a combination turn-up tape dispenser apparatus with automated and manual modules is illustrated. FIGS. 19A and 19B show a dispenser including a powered winder, a reservoir, a powered drive wheel, a manual drive wheel, a manual view port, a manual nip cylinder, and an automated nip cylinder. The end of a supply of paper band 1901 may be inserted into slot 1902 in winding hub 1903. A motor 1904 (See FIG. 19B) may then be actuated by, for example, sequencing push-button on a control panel to wind a coil of paper band 1905 to a predetermined length. The coiled paper band may then be cut using a hand tool or other cutting means. The coiled paper band may then be removed from the powered hub and placed into reservoir 1906 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 1907 of the manual module track, in some embodiments as far as view port 1908, and nip cylinder 1909 may be actuated by, for example, pressing a sequencing button on a control panel to pinch the paper band against the manual module's drive wheel 1910. Similarly, the end of the paper band from the automated module may be inserted into the automated module track inlet 1911 and pushed as far as view port 1908. Nip cylinder 1912 may be actuated by, for example, pressing a sequencing button on a control panel to pinch the paper band against the automated module's drive wheel 1913. In some embodiments, the module may also be configured to respond to signals from the module to initiate loading through a cross-machine track across a prescribed distance to a desired position to prepare for the turn-up. Similarly, if an operator wishes to perform a turn-up with the manual module, the operator may turn hand crank 1914 of the manual module's drive wheel to load the paper band across the paper machine through a cross-machine track to a prescribed position by, for example, pressing a sequencing button on a control panel. The procedures described above for effecting turn-up with automatic or manual tape dispensing modules may be used, as applicable, with the tape dispensers in this embodiment.

Figure 20A:
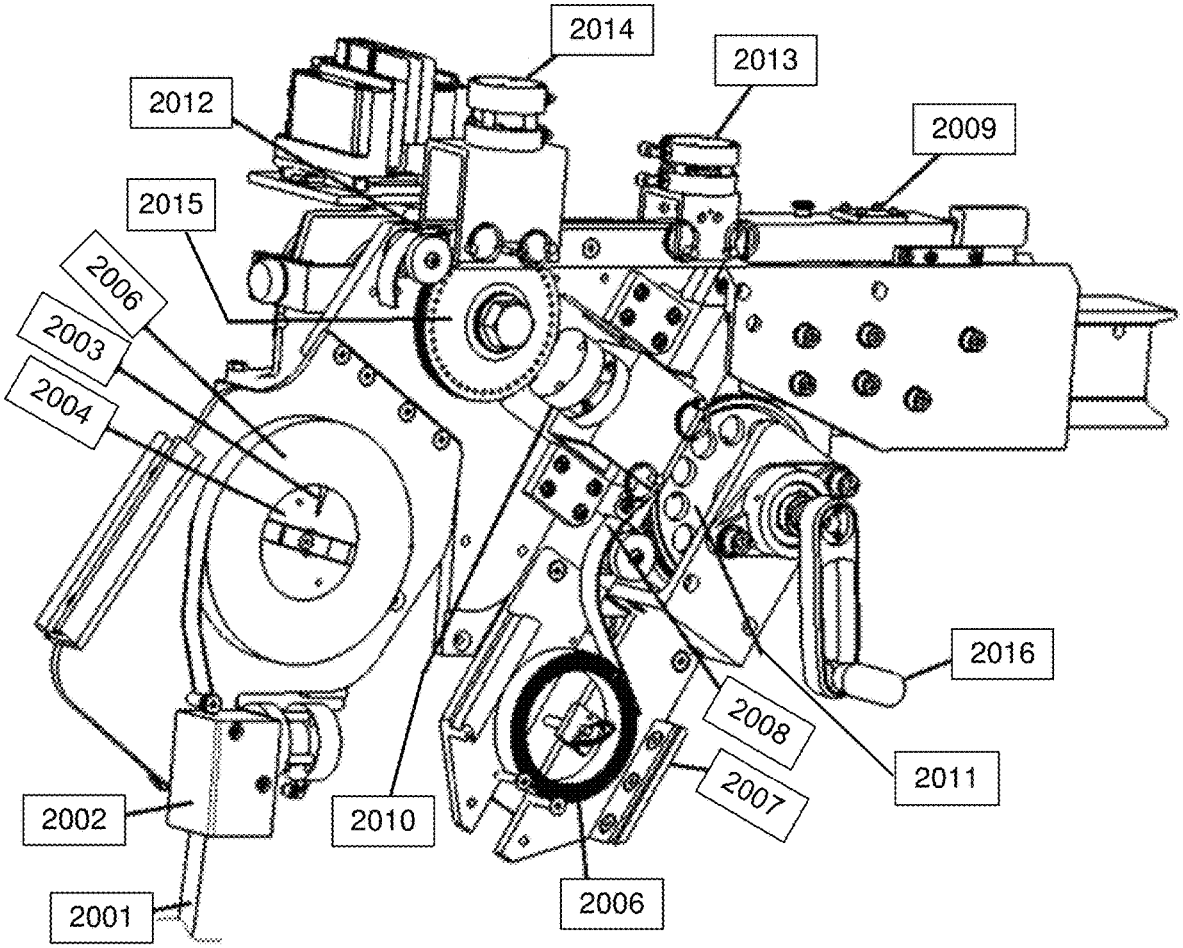
FIG. 20A illustrates a side perspective view of a transfer tape dispenser including an automated tape dispensing module and a manual tape dispensing module according to a particular embodiment of the invention.
Figure 20B:
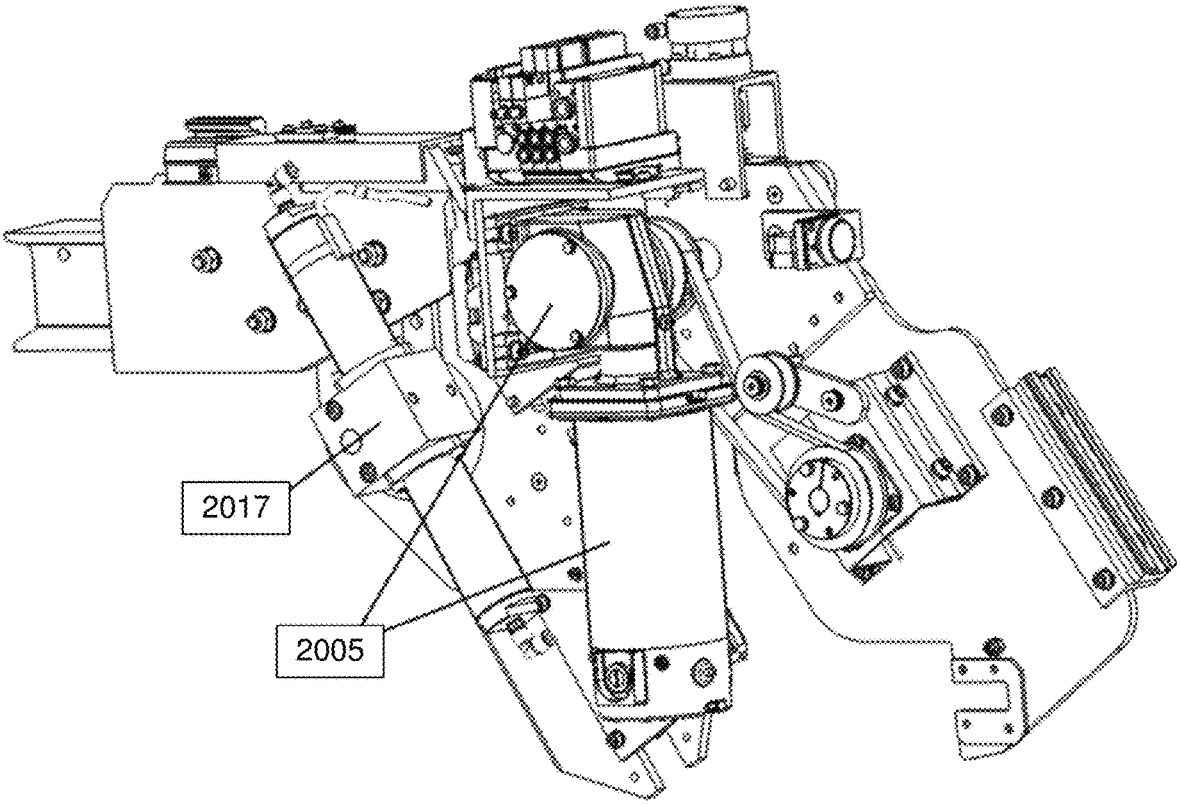
FIG. 20B illustrates a different side perspective view of the transfer tape dispenser in FIG. 20A.

An optional component of a tape dispenser including both manual and automated modules is a cutting device. FIGS. 20A and 20B illustrate a dispenser with an automated unicharger, a reservoir, powered and manual drive wheels, a retractable stop, and a cutter. The end of a supply of paper band 2001 may be inserted through a cutting mechanism 2002 (e.g., a pneumatic cutter) and into slot 2003 in winding hub 2004 of the automated unicharger. A motor 2005 (e.g., a DC motor; see FIG. 20B) may then be actuated by, for example, sequencing push-button on a control panel to wind a coil of paper band 2006 to a predetermined length. The coiled paper band may then be cut using the cutting mechanism 2002. The coiled paper band may then be removed from the powered hub and placed into reservoir 2007 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 2008 of the manual module track, in some embodiments as far as view port 2009, and nip cylinder 2010 may be actuated by, for example, pressing a sequencing button on a control panel to pinch the paper band against the manual module's drive wheel 2011. Similarly, the end of the paper band from the automated module may be inserted into the automated module track inlet 2012 and pushed as far as retractable stop 2013. Nip cylinder 2014 may be actuated by, for example, pressing a sequencing button on a control panel to pinch the paper band against the automated module's drive wheel 2015. The retractable stop may be withdrawn, e.g., approximately simultaneously, upon actuation of the automated module's nip cylinder 2014. The automated module motor may then be actuated to rotate the automated module's drive wheel 2015 to push the paper band across the paper machine through a cross-machine track to a prescribed position. Similarly, if an operator wishes to perform a turn-up with the manual module, the operator may turn hand crank 2016 of the manual module's drive wheel 2011 to push the paper band across the paper machine through a cross-machine track to a prescribed position. The procedures described above for effecting turn-up with automatic or manual tape dispensing modules may be used, as applicable, with the tape dispensers in this embodiment.

Figure 21A:
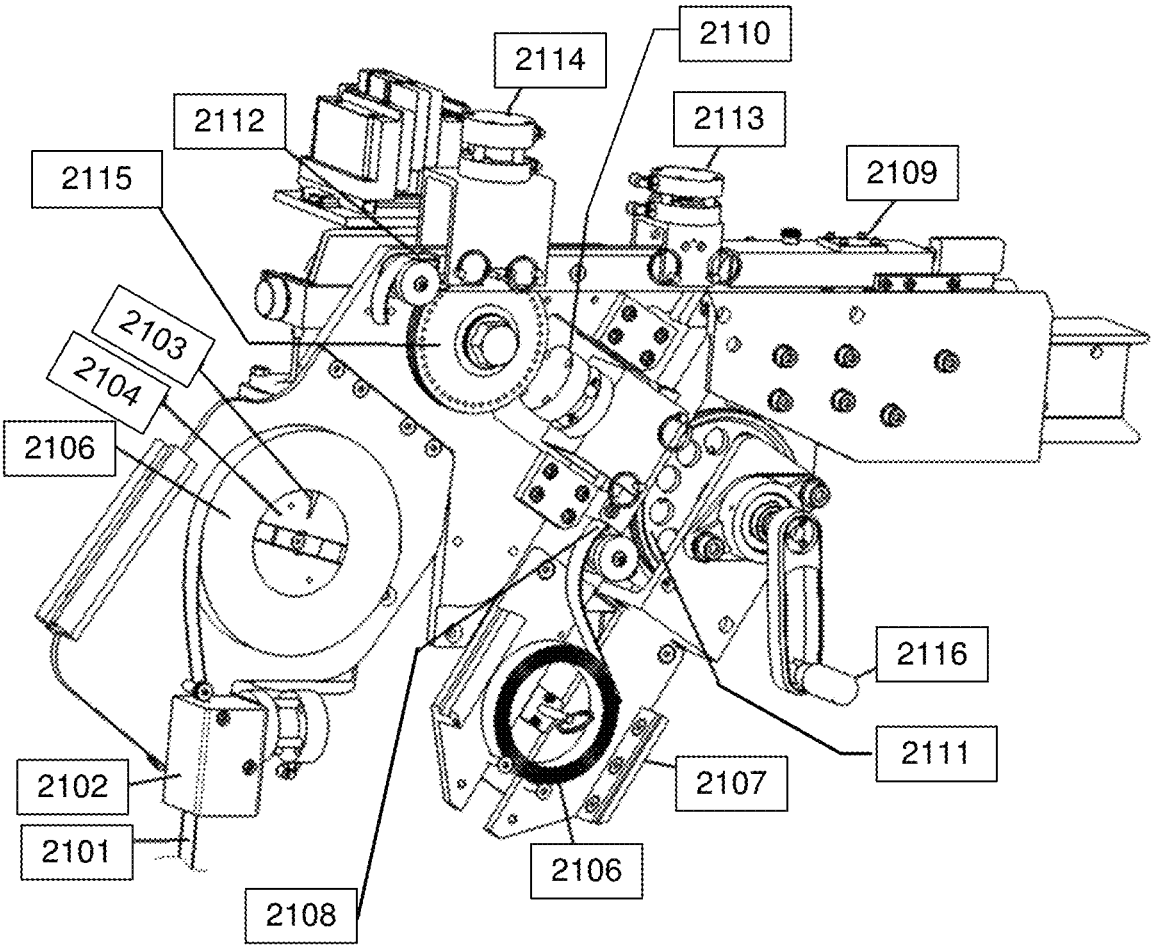
FIG. 21A illustrates a side perspective view of a transfer tape dispenser including an automated tape dispensing module and a manual tape dispensing module according to a particular embodiment of the invention.
Figure 21B:
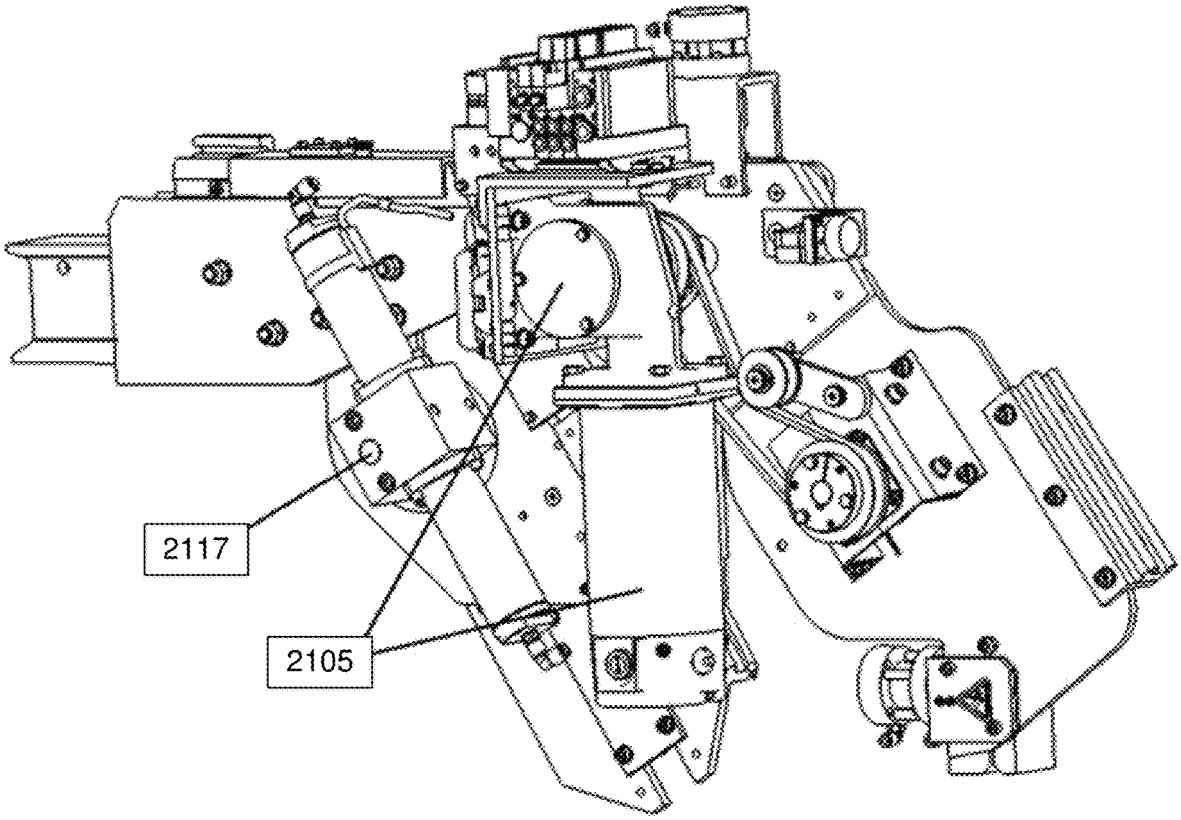
FIG. 21B illustrates a different side perspective view of the transfer tape dispenser in FIG. 21A.

FIGS. 21A and 21B illustrate another example of a turn-up tape dispenser apparatus with automated and manual modules. Specifically, the tape dispenser comprises an automated unicharger, a reservoir, a cutting mechanism, manual and powered drive wheels, and a retractable stop. The end of a supply of paper band 2101 may be inserted through a cutting mechanism 2102 and into slot 2103 in winding hub 2104. A motor 2105 (FIG. 21B) may then be actuated by, for example, sequencing push-button on a control panel to wind a coil of paper band 2106 to a predetermined length. The coiled paper band may then be cut using cutting mechanism 2102. The coiled paper band may then be removed from the powered hub and placed into reservoir 2107 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 2108 of the manual module track, in some embodiments as far as view port 2109, and nip cylinder 2110 may be actuated by, for example, pressing a sequencing button on a control panel to pinch the paper band against the manual module's drive wheel 2111. Similarly, the end of the paper band from the automated module may be inserted into the automated module track inlet 2112 and pushed as far as retractable stop 2113. Nip cylinder 2114 may be actuated by, for example, pressing a sequencing button on a control panel to pinch the paper band against the automated module's drive wheel 2115. The retractable stop may be withdrawn approximately simultaneously upon actuation of the second nip cylinder 2114. The automated module's motor may then be actuated to rotate the automated module's drive wheel to load the paper band across the paper machine through a cross-machine track to a prescribed position. Similarly, if an operator wishes to perform a turn-up with the manual module, the operator may turn hand crank 2116 of the manual module's drive wheel to load the paper band across the paper machine through a cross-machine track to a prescribed position. The procedures described above for effecting turn-up with automatic or manual tape dispensing modules may be used, as applicable, with the tape dispensers in this embodiment.

Figure 22A:
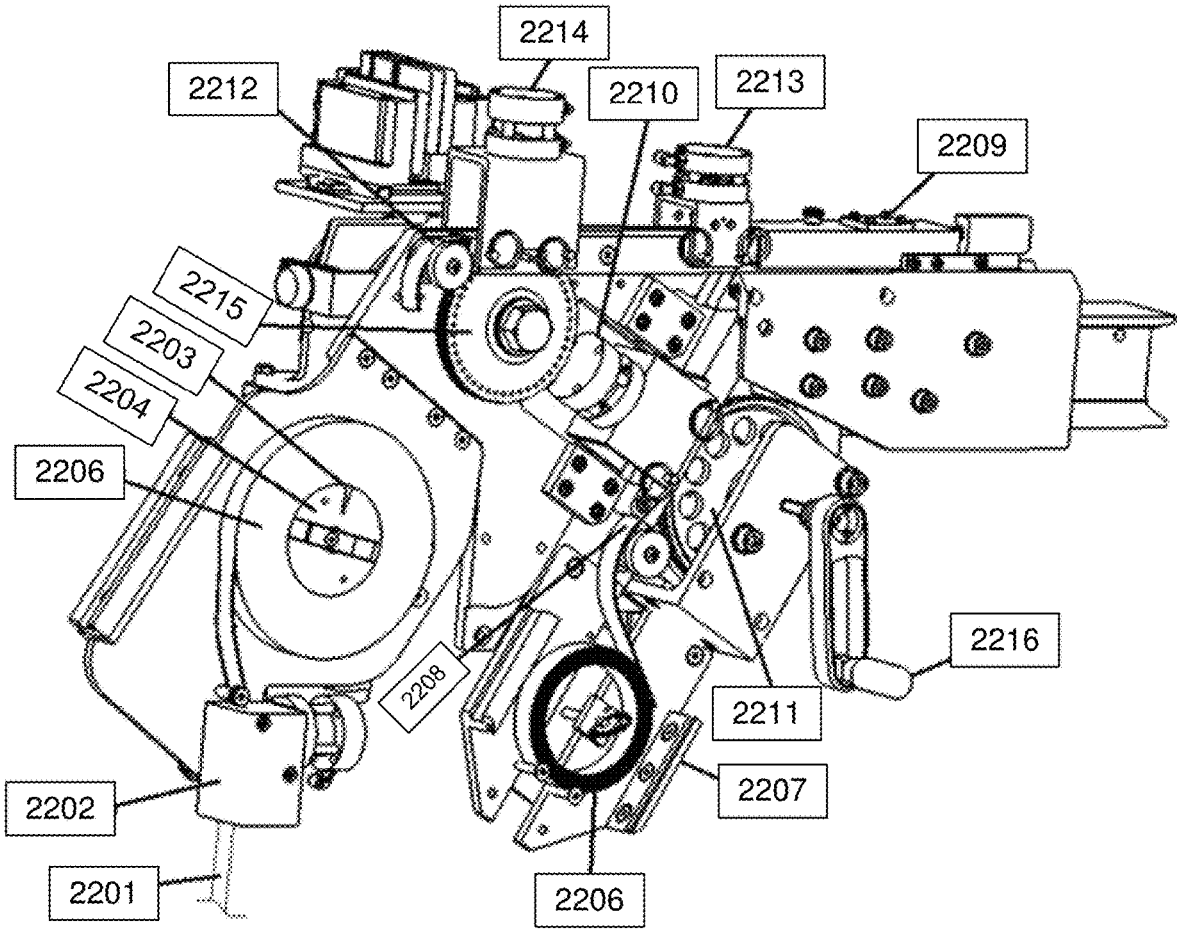
FIG. 22A illustrates a side perspective view of a transfer tape dispenser including an automated tape dispensing module and a manual tape dispensing module according to a particular embodiment of the invention.
Figure 22B:
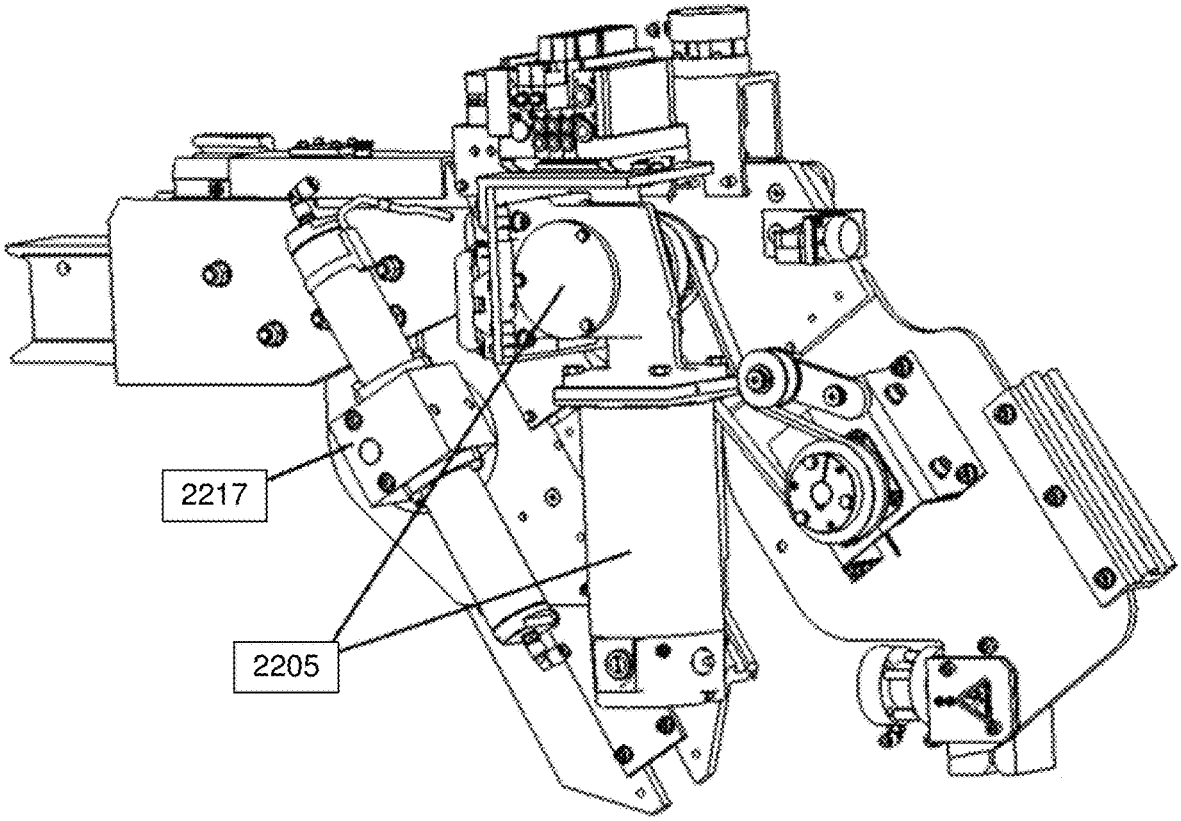
FIG. 22B illustrates a different side perspective view of the transfer tape dispenser in FIG. 22A.

FIGS. 22A and 22B show an additional model of a turn-up tape dispenser apparatus with automated and manual modules that includes optional features such as a mechanical counter. Specifically, the automated/manual apparatus comprises an automated unicharger, a reservoir, a cutting mechanism, powered and manual drive wheels, a retractable stop, and a mechanical counter. The end of a supply of paper band 2201 may be inserted through a cutting mechanism 2202 and into slot 2203 in winding hub 2204 of the unicharger. A motor 2205 (See FIG. 22B) may then be actuated by, for example, sequencing push-button on a control panel to wind a coil of paper band 2206 to a predetermined length. The coiled paper band may then be cut using cutting mechanism 2202. The coiled paper band may then be removed from the powered hub and placed into reservoir 2207 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 2208 of the manual module track, in some embodiments as far as view port 2209, and nip cylinder 2210 may be actuated by, for example, pressing a sequencing button on a control panel to pinch the paper band against the manual module's drive wheel 2211. Similarly, the end of the paper band from the automated module may be inserted into the automated module track inlet 2212 and pushed as far as retractable stop 2213. Nip cylinder 2214 may be actuated by, for example, pressing a sequencing button on a control panel to pinch the paper band against the automated module's drive wheel 2215. The retractable stop may be withdrawn approximately simultaneously upon actuation of the second nip cylinder 2214. The automated module's motor may then be actuated to rotate the automated module's drive wheel 2215 to load the paper band across the paper machine through a cross-machine track to a prescribed position. Similarly, if an operator wishes to perform a turn-up with the manual module, the operator may turn hand crank 2216 of the manual module's drive wheel 2211 to load the paper band across the paper machine through a cross-machine track to a prescribed position. The procedures described above for effecting turn-up with automatic or manual tape dispensing modules may be used, as applicable, with the tape dispensers in this embodiment.

Figure 23A:
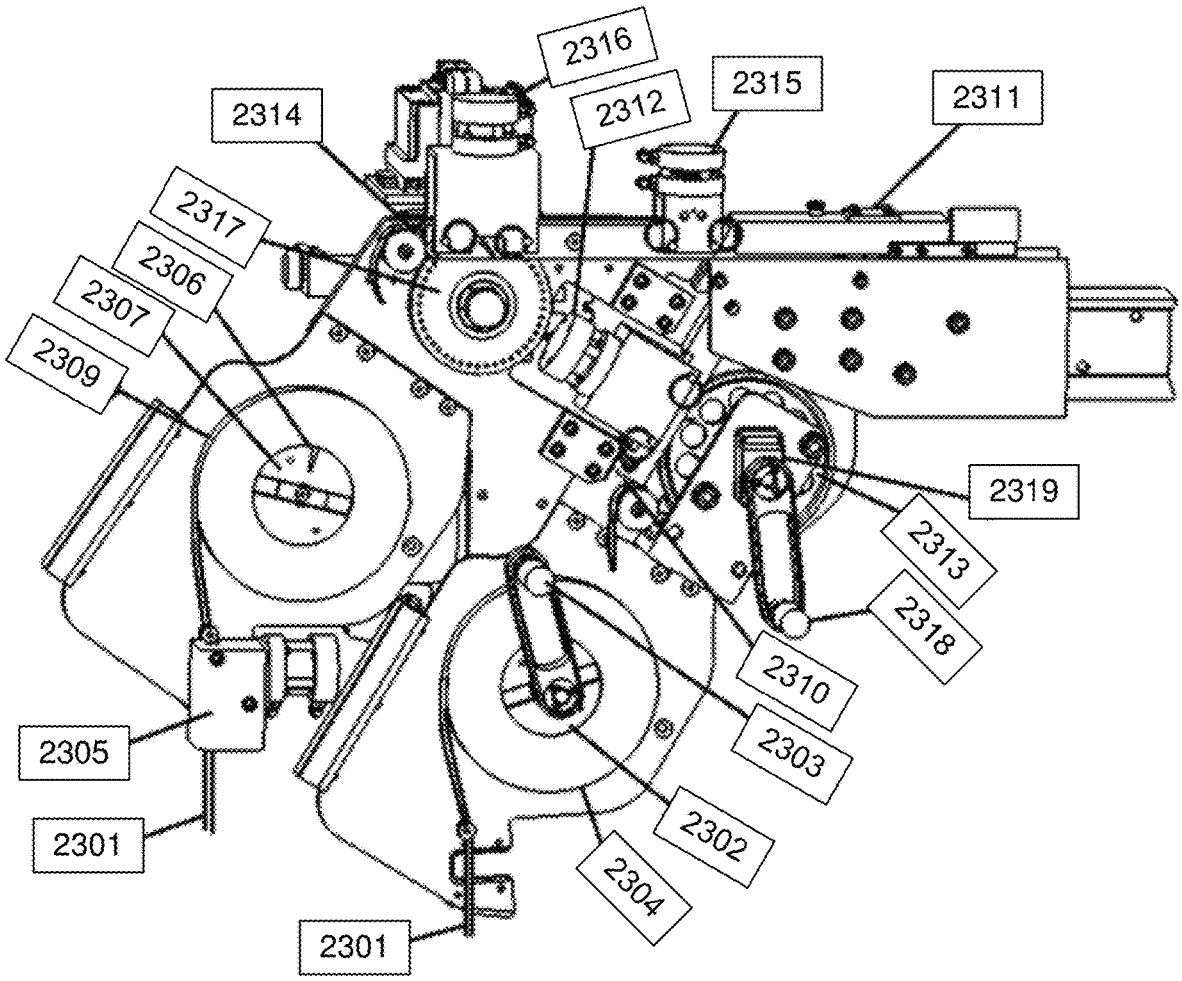
FIG. 23A illustrates a side perspective view of a transfer tape dispenser including an automated tape dispensing module and a manual tape dispensing module according to a particular embodiment of the invention.
Figure 23B:
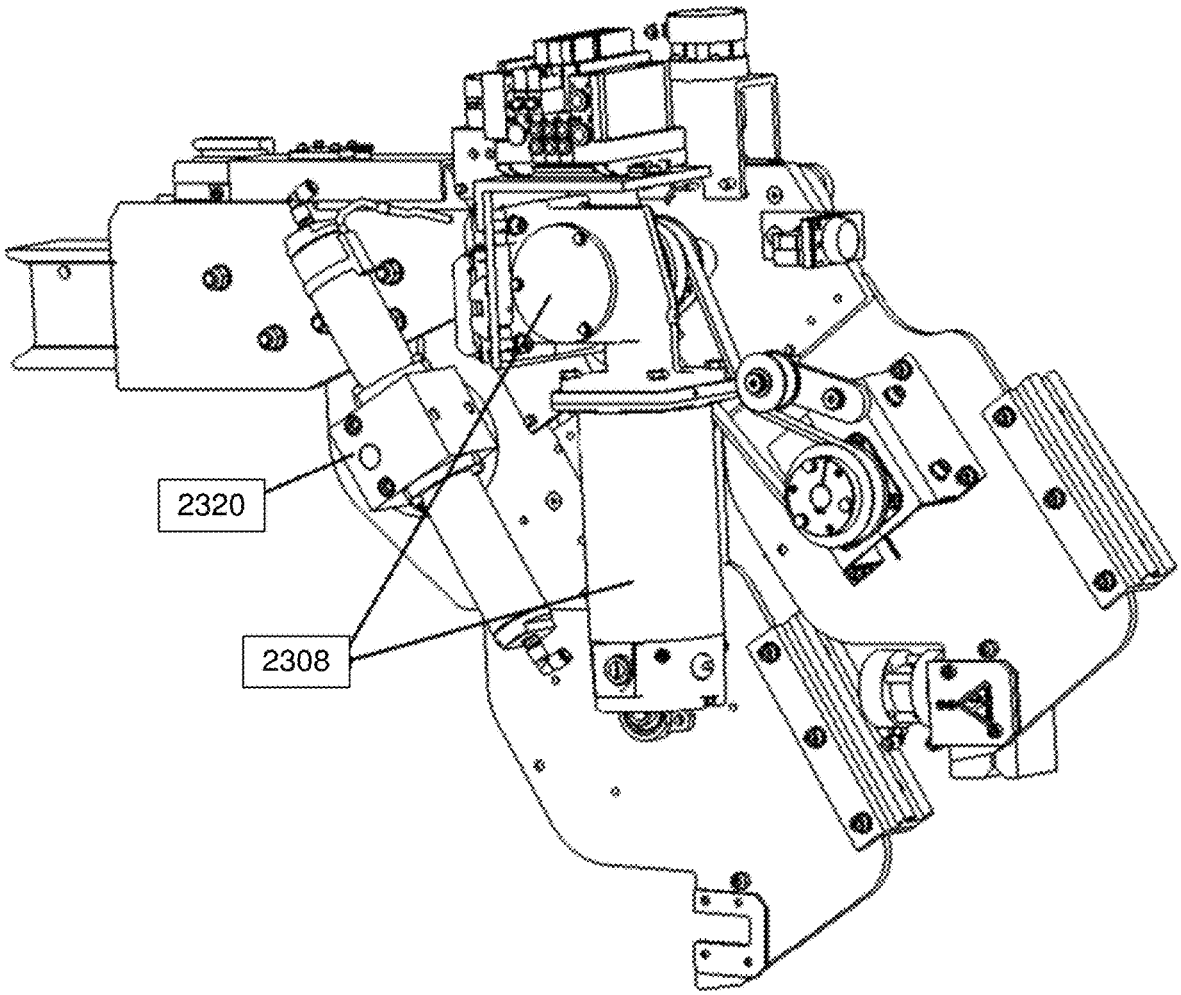
FIG. 23B illustrates a different side perspective view of the transfer tape dispenser in FIG. 23A.

FIGS. 23A and 23B show another configuration of a turn-up tape dispenser apparatus having automated and manual modules. Specifically, the tape dispensing apparatus comprises an automated unicharger, a manual unicharger, a cutting mechanism, powered and manual drive wheels, and a retractable stop. The end of a supply of paper band 2301 may be inserted into a slot in the manual module's winding hub 2302 of the unicharger. Hand crank 2303 may be engaged into the winding hub of the manual unicharger and turned to wind a desired length of paper band into a coil 2304; the paper band may then be cut with a hand tool. The paper band may then be threaded through cutter 2305 into slot 2306 of powered winding hub 2307. A motor 2308 (See FIG. 23B) may then be actuated by, for example, sequencing push-button on a control panel to wind a coil of paper band 2309 to a predetermined length. The coiled paper band may then be automatically cut by cycling the cutting mechanism. A length of adhesive may then be applied to the ends of both coils of paper band. The end of the paper band from the manual module reservoir may be inserted into the inlet 2310 of the manual module track, in some embodiments as far as view port 2311, and nip cylinder 2312 may be actuated by, for example, pressing a sequencing button on a control panel to pinch the paper band against the manual module's drive wheel 2313. Similarly, the end of the paper band from the automated module may be inserted into the automated module track inlet 2314 and pushed as far as retractable stop 2315. Nip cylinder 2316 may be actuated by, for example, pressing a sequencing button on a control panel to pinch the paper band against the automated module's drive wheel 2317. The retractable stop may be withdrawn approximately simultaneously upon actuation of the automated module's nip cylinder 2316. The automated module's motor may then be actuated to rotate the automated module drive wheel 2317 to load the paper band across the paper machine through a cross-machine track to a prescribed position. Similarly, if an operator wishes to perform a turn-up with the manual module, the operator may turn hand crank 2318 of the manual module's drive wheel 2313 to load the paper band across the paper machine through a cross-machine track to a prescribed position. The procedures described above for effecting turn-up with automatic or manual tape dispensing modules may be used, as applicable, with the tape dispensers in this embodiment.

Figure 24A:
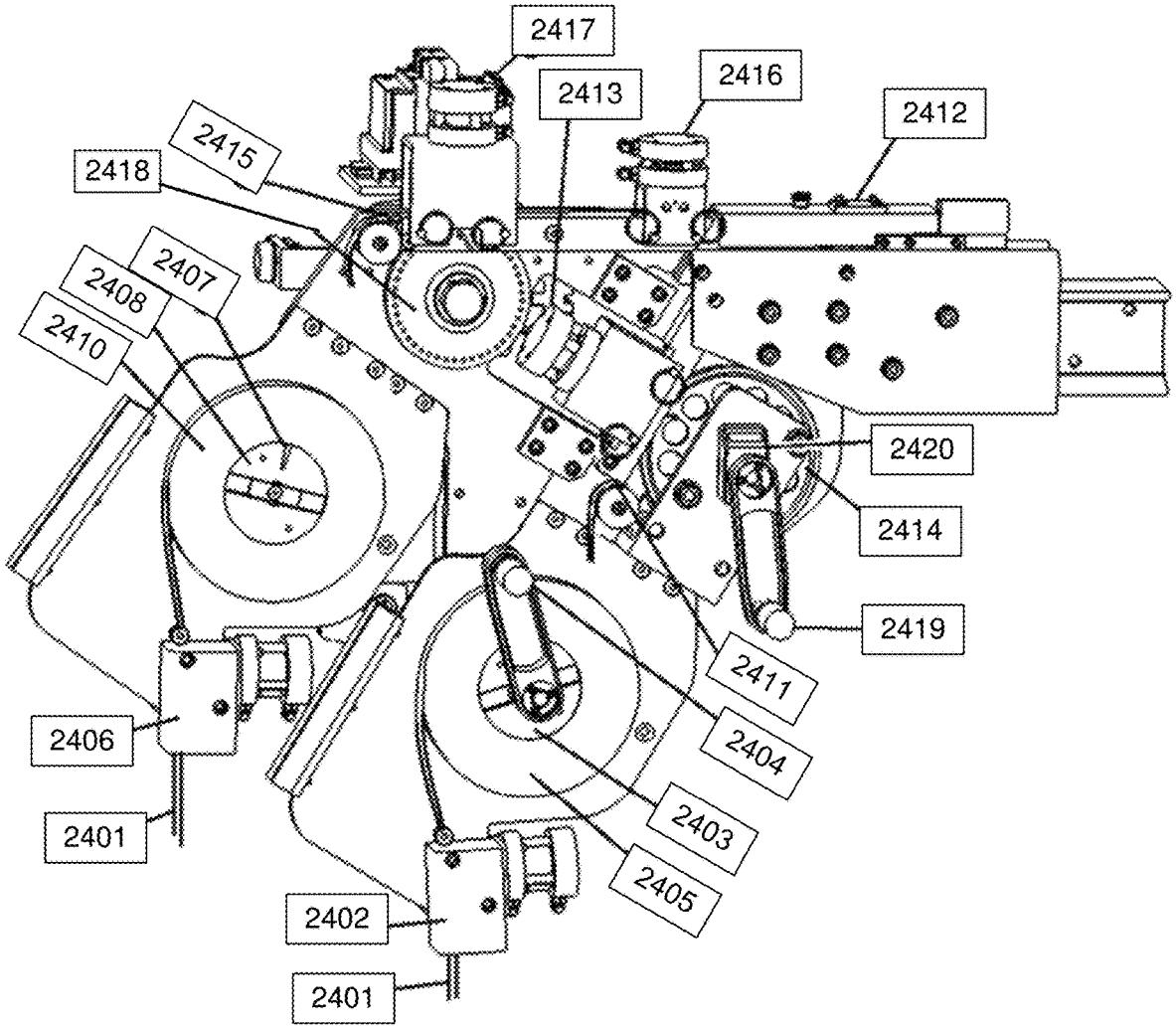
FIG. 24A a side perspective view of a transfer tape dispenser including an automated tape dispensing module and a manual tape dispensing module according to a particular embodiment of the invention.
Figure 24B:
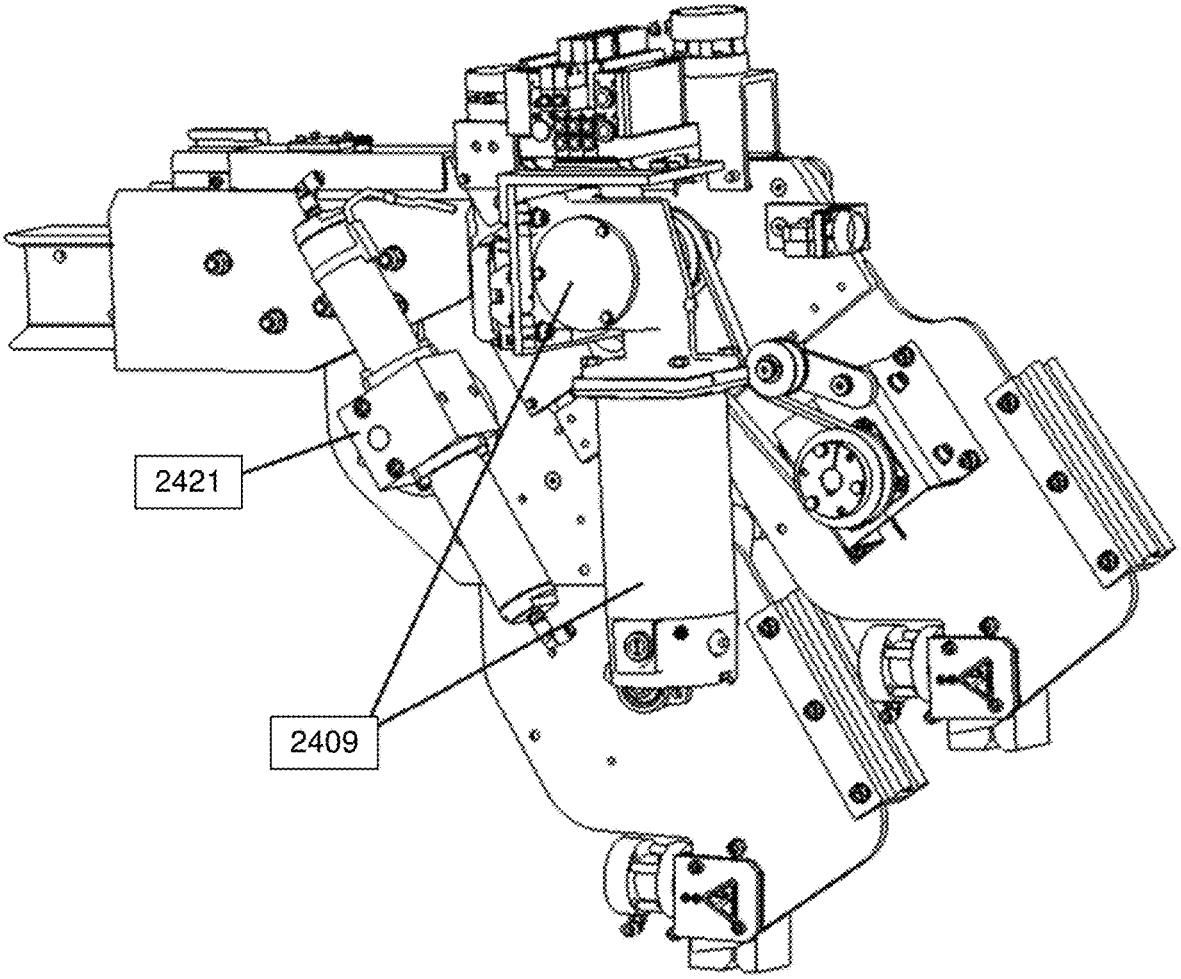
FIG. 24B illustrates a different side perspective view of the transfer tape dispenser in FIG. 24A.

Finally, FIGS. 24A and 24B illustrate an alternative model of a turn-up tape dispenser with automated and manual modules. Specifically, the dispenser comprises an automated unicharger, a manual unicharger, cutting mechanisms, powered and a manual drive wheels, and a retractable stop. The end of a supply of paper band 2404 may be inserted through cutting mechanism 2402 and into a slot in the module's winding hub 2403. Hand crank 2404 may be engaged into the winding hub and turned to wind a desired length of paper band into a coil 2405; the paper band may then be cut by actuating cutting mechanism 2402 for the manual module by, for example, pressing a sequencing button on a control panel. The paper band may then be threaded through a cutter associated with the automated module 2406 and inserted into slot 2407 of powered winding hub 2408. A motor 2409 (See FIG. 24B) may then be actuated by, for example, sequencing push-button on a control panel to wind a coil of paper band 2410 to a predetermined length. The coiled paper band may then be automatically cut by cycling the cutting mechanism. A length of adhesive may then be applied to the ends of both coils of paper band. The end of the paper band from the manual module reservoir may be inserted into the inlet 2411 of the manual module track, in some embodiments as far as view port 2412, and nip cylinder 2413 may be actuated by, for example, pressing a sequencing button on a control panel to pinch the paper band against the manual module's drive wheel 2414. Similarly, the end of the paper band from the automated module may be inserted into the automated module track inlet 2415 and pushed as far as retractable stop 2416. Nip cylinder 2417 may be actuated by, for example, pressing a sequencing button on a control panel to pinch the paper band against the automated module's drive wheel 2418. The retractable stop may be withdrawn approximately simultaneously upon actuation of the automated module's nip cylinder 2418. The automated module's motor may then be actuated to rotate the automated module drive wheel 2418 to load the paper band across the paper machine through a cross-machine track to a prescribed position. Similarly, if an operator wishes to perform a turn-up with the manual module of the machine, the operator may turn hand crank 2419 of the manual module's drive wheel 2414 to load the paper band across the paper machine through a cross-machine track to a prescribed position. The procedures described above for effecting turn-up with automatic or manual tape dispensing modules may be used, as applicable, with the tape dispensers in this embodiment.

Figure 25A:
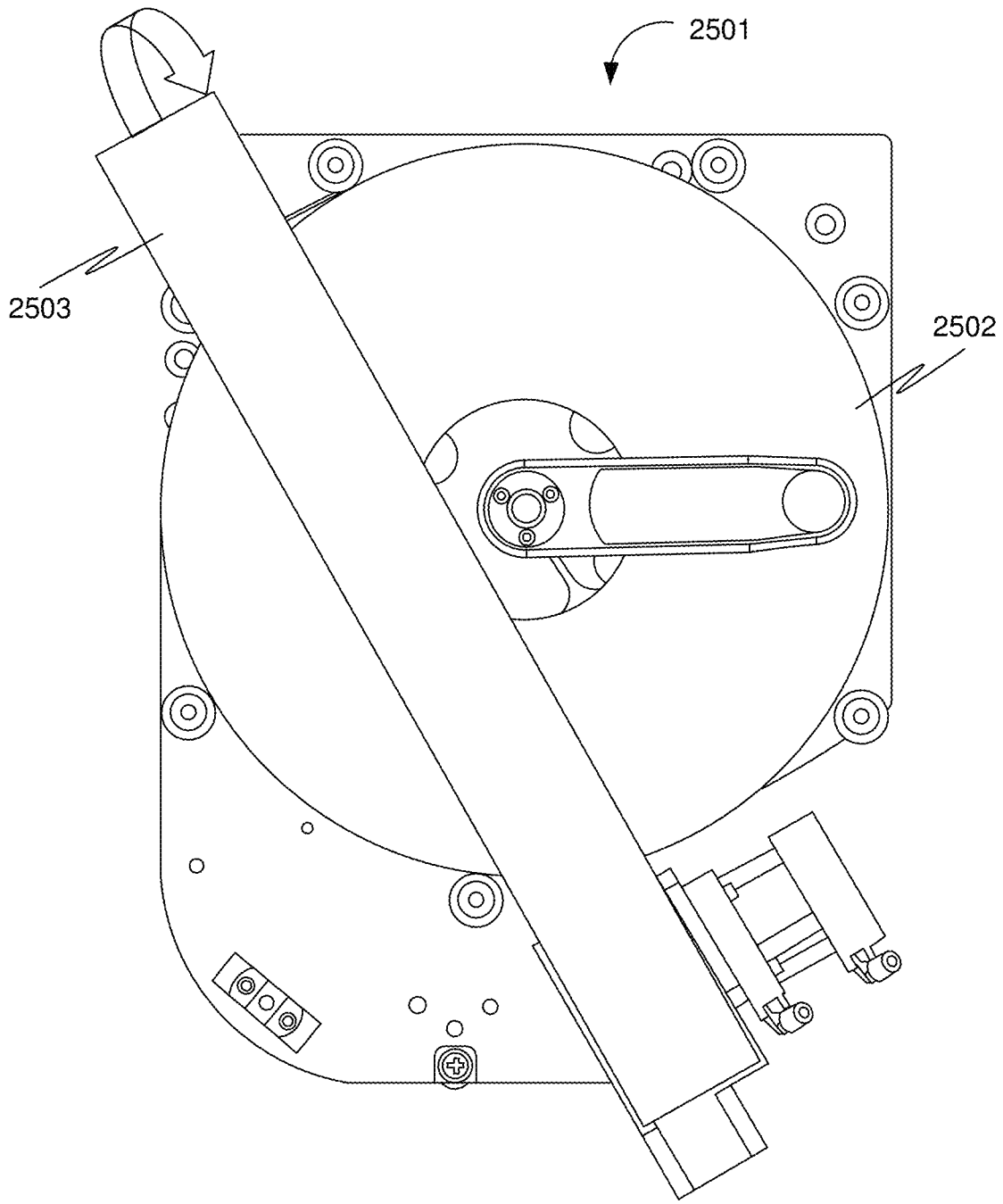
FIG. 25A illustrates a turn up tape coil keeper according to a particular embodiment of the invention.
Figure 25B:
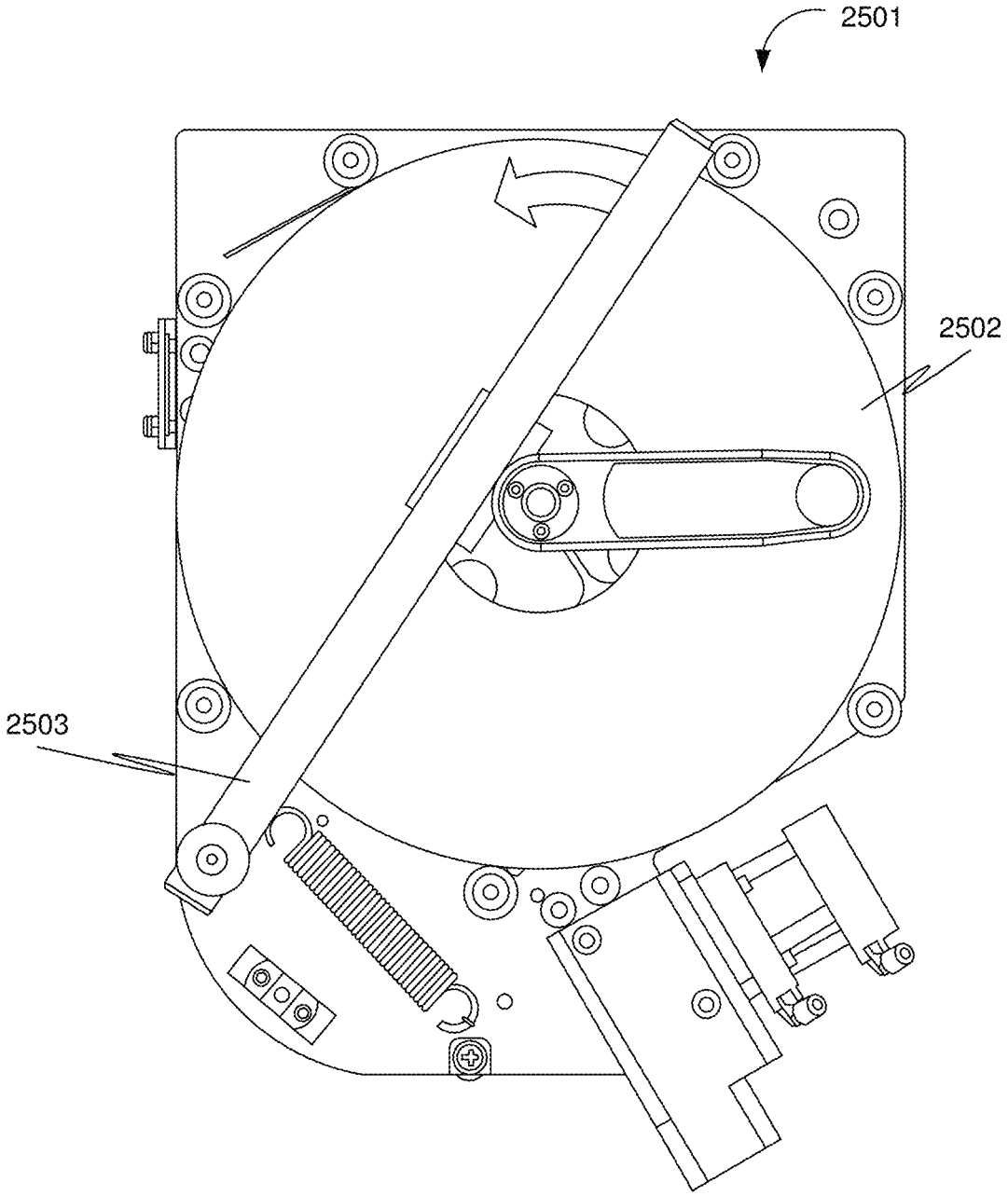
FIG. 25B illustrates a turn up tape coil keeper according to another embodiment of the invention.

Another feature that may be different configurations is the transfer tape coil keeper for a unicharger. Referring to FIGS. 25A and 25B, a unicharger 2501 (here, a manual unicharger) may include transfer tape coil 2502. In order to ensure that the transfer tape coil 2502 remains on the unicharger winding hub, a strap or bar, also referred to as a transfer tape coil keeper 2503, is secured across at least part of the transfer tape coil 2502. The transfer tape coil keeper 2503 may or may not touch a portion of the transfer tape coil 2502. The transfer tape coil keeper 2503 may be configured to be released or removed to allow for removal of a transfer tape coil 2502. As shown in FIG. 25A, in one example, the transfer tape coil keeper 2503 is removed by bending the transfer tape coil keeper 2503 toward the user to allow for room to remove the transfer tape coil 2502. As shown in FIG. 25B, in other cases, the transfer tape coil keeper 2503 may be rotated or pivoted (in this case counterclockwise) to allow for room to remove the transfer tape coil 2502. The transfer tape coil keeper 2503 may be made of any suitable shape or material including metal, fabric, and the like.

Further provided according to embodiments of the invention are single-use transfer tape dispensing boxes, and such single-use tape dispensing boxes may be used with an automatic or manual module described herein. Such single-use boxes include a length of paper band sufficient to perform one turn-up cycle in a paper-web turn-up procedure. In some embodiments of the invention, the box includes a hollow cavity; a coil of paper band housed within the hollow cavity, the paper band including a first face and a second face and a predetermined length suitable for a single turn-up procedure for slicing a paper roll on a paper machine, the paper band further including a proximal end and a distal end; and a slot on the box through which an proximal end of the coil of paper band may be fed to allow the end to pass outside the box.

The term "box," as used herein, encompasses any means of providing a hollow cavity for the coil of paper band, including a carton, cartridge, bag, case, container, and the like. Additionally, the term "hollow cavity" refers to the space in the box for the coil of paper band, but does not preclude the presence of other minor elements including, but not limited to, a hub on which the paper band may be coiled, support structures to maintain the position of the paper band coil in the box, lubricant, an adhesive applicator, and instructions or other documentation. Furthermore, when the paper band is said to be fed through a "slot," this term is meant to encompass any element of egress from the box, including a hole, slit, spout, exit, outlet, and the like.

Any suitable transfer tape may be used in the single-use boxes described herein. The length of transfer tape needed for a single-use will depend on the particular parameters of the turn-up machine, paper web machine, and the paper web. However, such single-use dispensing boxes may be manufactured at a few, some, or several different pre-measured lengths. The paper band length used by a particular paper machine/turn-up system is typically at least the length needed to perform one turn-up cycle but less than needed for two turn-up cycles. For example, if a particular paper web turn-up system requires 75 feet of paper band to perform one turn up cycle, the operator could install a single-use turn-up dispenser box that has at least 75 feet of transfer tape. For example, the operator could use a 100 feet single-use transfer tape dispensing box, and any excess paper tape (~25 feet) will not be used in the turn-up, but could be recycled for other uses.

In some embodiments of the invention, an adhesive is fixedly attached to the paper band and located at the proximal end of the paper band. Furthermore, in some embodiments, an adhesive liner is removably attached to the adhesive during storage in the single-use box and may be removed by an operator (or a mechanical or automated device) before performing a turn-up procedure. Typically, a pre-applied adhesive is only present on a first 6 to 12, 18, 24, or 36 inches of the proximal end of the paper tape coil, but any amount of pre-applied adhesive suitable for performing a paper web turn-up procedure may be present.

The single-use paper tape dispensing boxes may be used in or with any suitable transfer tape dispensing apparatus, provided that there is a securing means, including but not limited to those described herein, to secure the box against excessive movement during a turn-up procedure. In some embodiments, such apparatus may not include a cutting means since the paper tape does not need to be cut prior to use in the apparatus. The single-use tape dispensing boxes may be used to sever a paper web in any paper web turn-up procedure known to those of skill in the art, including, but not limited to, those described herein.

Figure 26:
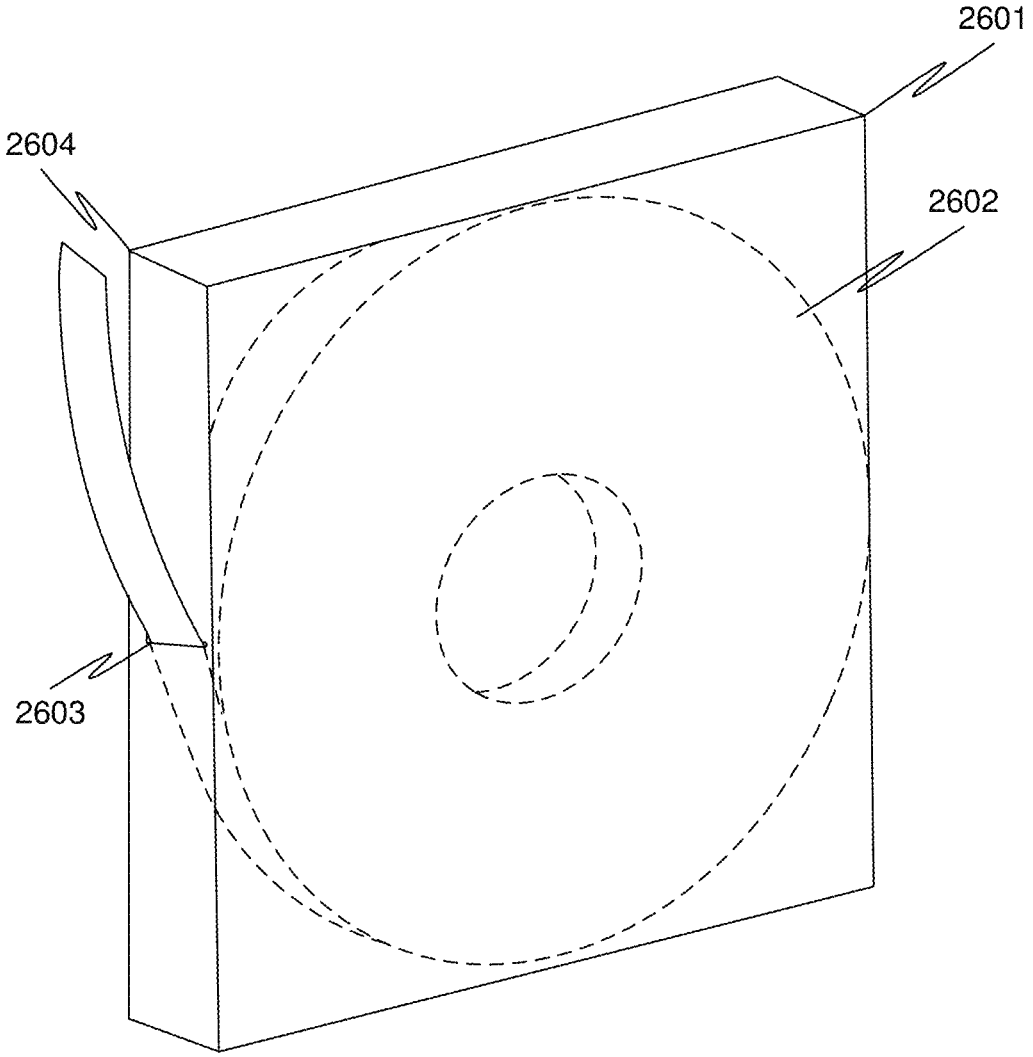
FIG. 26 illustrates a single use transfer tape dispenser box according to an embodiment of the invention.

In FIG. 26, an embodiment of a single-use tape dispensing box is shown. A single-use box 2601 is proportioned to enclose paper band coil 2602 in a hollow cavity within single-use box 2601. In particular embodiments, paper band coil 2602 is a flat, ribbon-wound coil. Moreover, in some embodiments, the base length of single-use box 2601 (i.e., the distance between its sidewalls) is slightly longer (e.g., less than 2%, 5% or 10% longer) than the width of the paper band coil 2602 to prevent the paper band coil 2602 from telescoping or tangling in transit, storage, and use.

Single-use box 2601 may include slot 2603 through which the paper band coming off paper band coil 2602 may exit. This may allow access to the paper band without opening single-use box 2601. The slot 2603 may be at any suitable position on the sidewall including the top, bottom, or substantially at the midpoint of the sidewall as shown. In some embodiments, single-use box 2601 may further include a door or some other mechanism to allow for retrieval of an end of paper band coil 2602 in case an end is no longer accessible outside slot 2603. This end of paper band coil 2602 may be secured against snagging or unintentional pulling out from the box by tucking it into box edge 2604 or other similar means. The end may also be secured to the outside of the box by an adhesive, pin, band, or other securing means.

The hollow cavity in single-use box 2601 may take any desirable shape. For example, in some embodiments, the hollow cavity may be a quadrilateral of sufficient size to inscribe paper band coil 2602 within it. The hollow cavity may have space around its corners that is unoccupied by paper band coil 2602 to allow pins, nails, or other securing means to pass through the hollow cavity. The hollow cavity may include a lubricant, an adhesive applicator, or other useful apparatus. In some embodiments, single-use box 2601 may include a means of ingress into the hollow cavity for quality control purposes with respect to issues that may arise with the dispensing of paper band coil 2602.

Figure 27A:
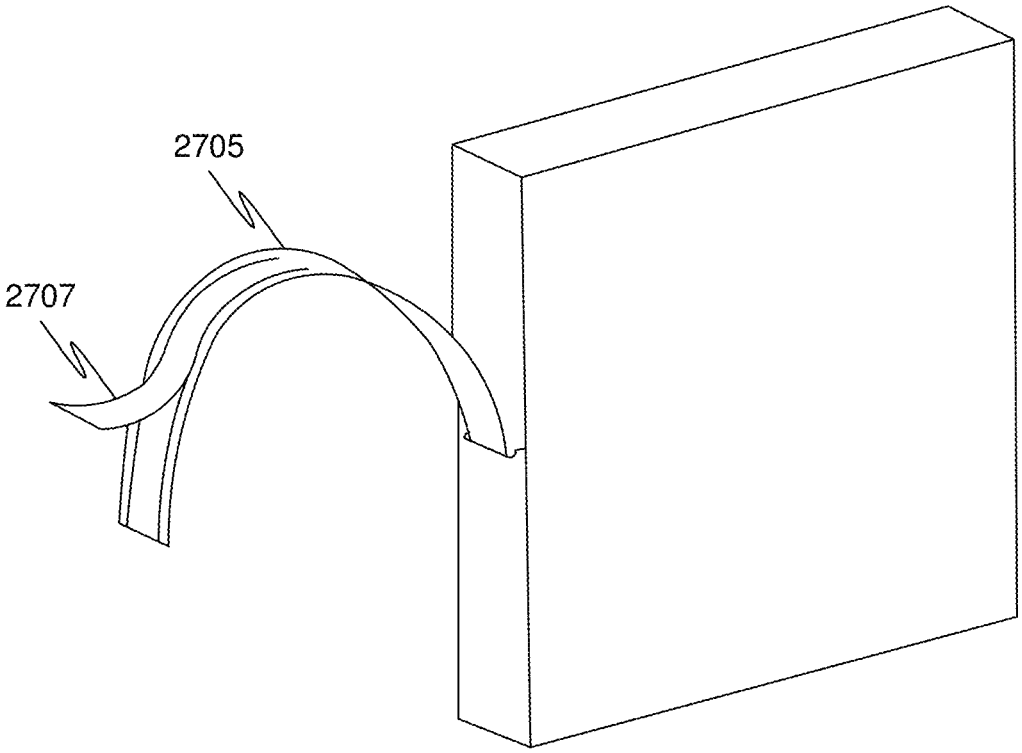
FIGS. 27A and 27B illustrate that adhesive may be applied to either side of the transfer tape in a single use tape dispenser box according to an embodiment of the invention.
Figure 27B:
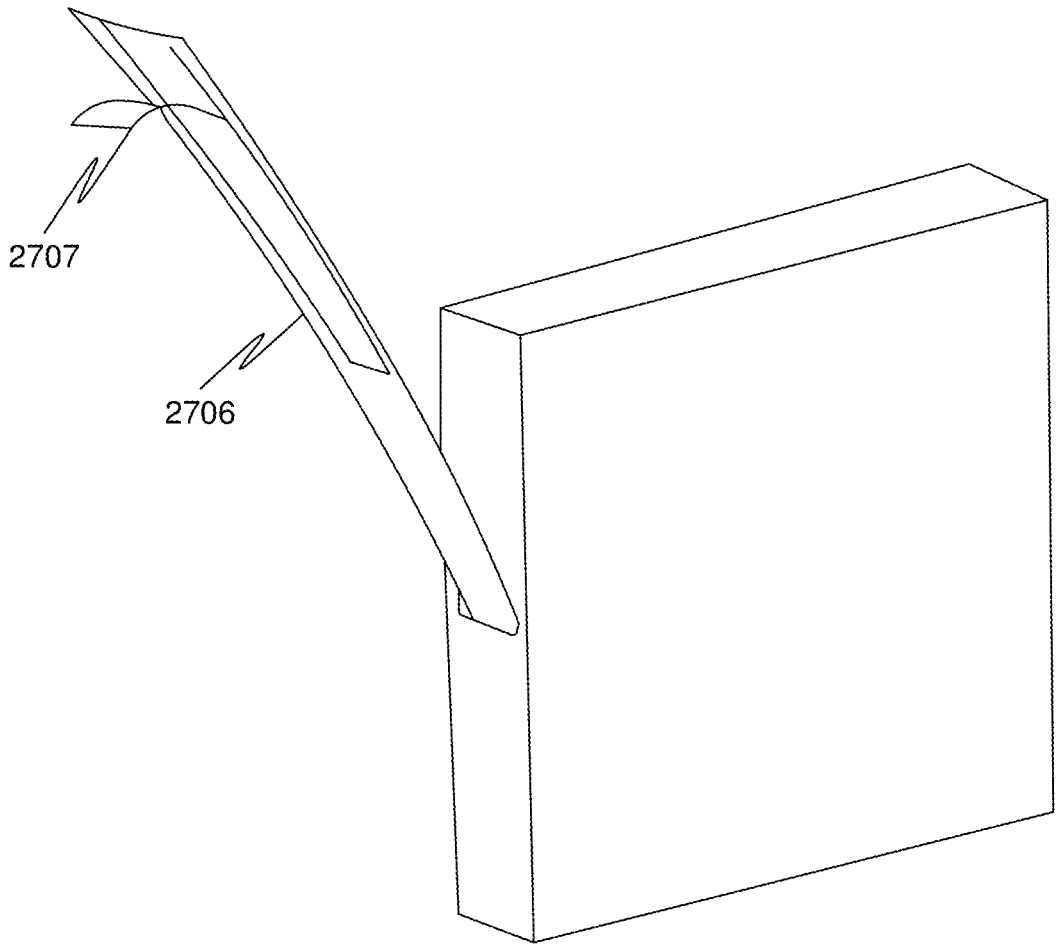

Referring now to FIGS. 27A and 27B, particular adhesive application methodologies are shown. The method of applying adhesive may vary depending on the configuration of the tape dispensing apparatus used. Adhesive may be applied to the exposed inner face 2705 or outer face 2706 of the paper band. The face on which the adhesive may be applied may be based on the configuration of a particular module. In some embodiments, no adhesive liner 2707 is used. Furthermore, in some embodiments, the adhesive discussed in connection with FIGS. 27A and 27B need not be pre-applied—it can be applied by an operator on site. In other embodiments, adhesive liner 2707 may be removably attached from the proximal end of the paper band to allow for easier shipping of paper band coil. Once removed on site, the adhesive liner 2707 may leave behind an appropriate amount of adhesive on the paper band.

Figure 28:
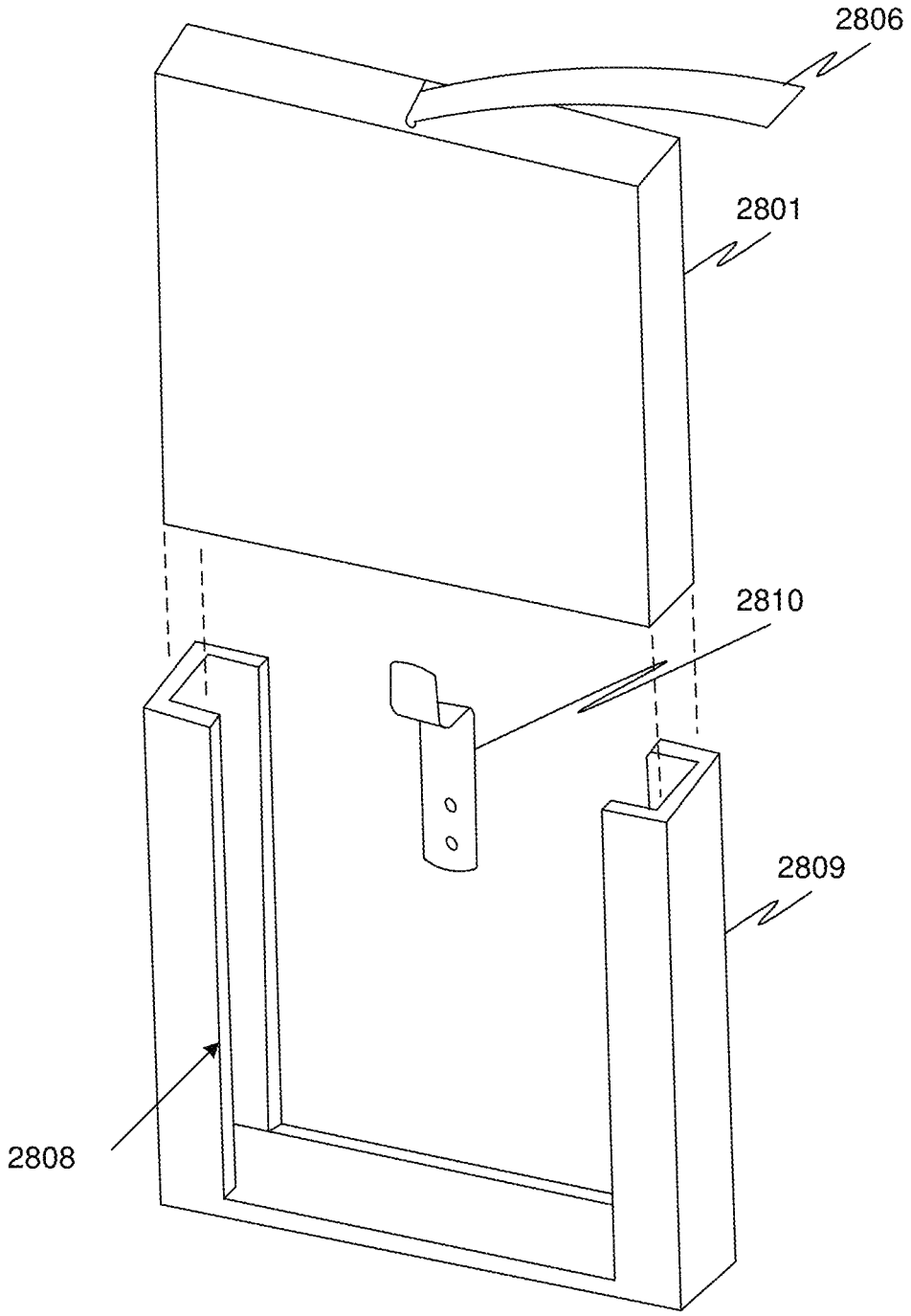
FIG. 28 illustrates an example of a single use tape dispenser box holder configuration.

Referring now to FIG. 28, an embodiment of the single-use box 2801 in use with a holder 2809 is shown. The holder 2809 may be proximate to, or present within, a paper web tape dispensing system. Doing so allows an operator to free the exposed end 2806 of the paper band. After freeing exposed end 2806, the operator may remove the liner (not shown) from the adhesive strip and insert exposed end 2806 into a nip cylinder/drive mechanism of a tape dispensing module. In some embodiments, holder 2809 may be fixedly or removably attached to a reservoir of a tape dispensing module by a securing means including, but not limited to, screws, protrusions, hinges, clips, magnets, adhesive, and the like.

In some embodiments, holder 2809 may comprise one or more channels 2808 in which the narrow edges of single-use box 2801 may slide. In some embodiments, holder 2809 may further comprise clips 2810 to secure single-use box 2801 in holder 2809 by, for example, a clip across the opening of the receiver. In some embodiments, channels 2808 may comprise magnetic strips or other similar temporary-adhesion means to secure single-use box 2801 in holder 2809 temporarily. In some embodiments, channels 2808 may include additional sealing mechanisms, such as slidable stops to prevent single-use box 2801 from moving in holder 2809 after being placed in holder 2809.

Figure 29:
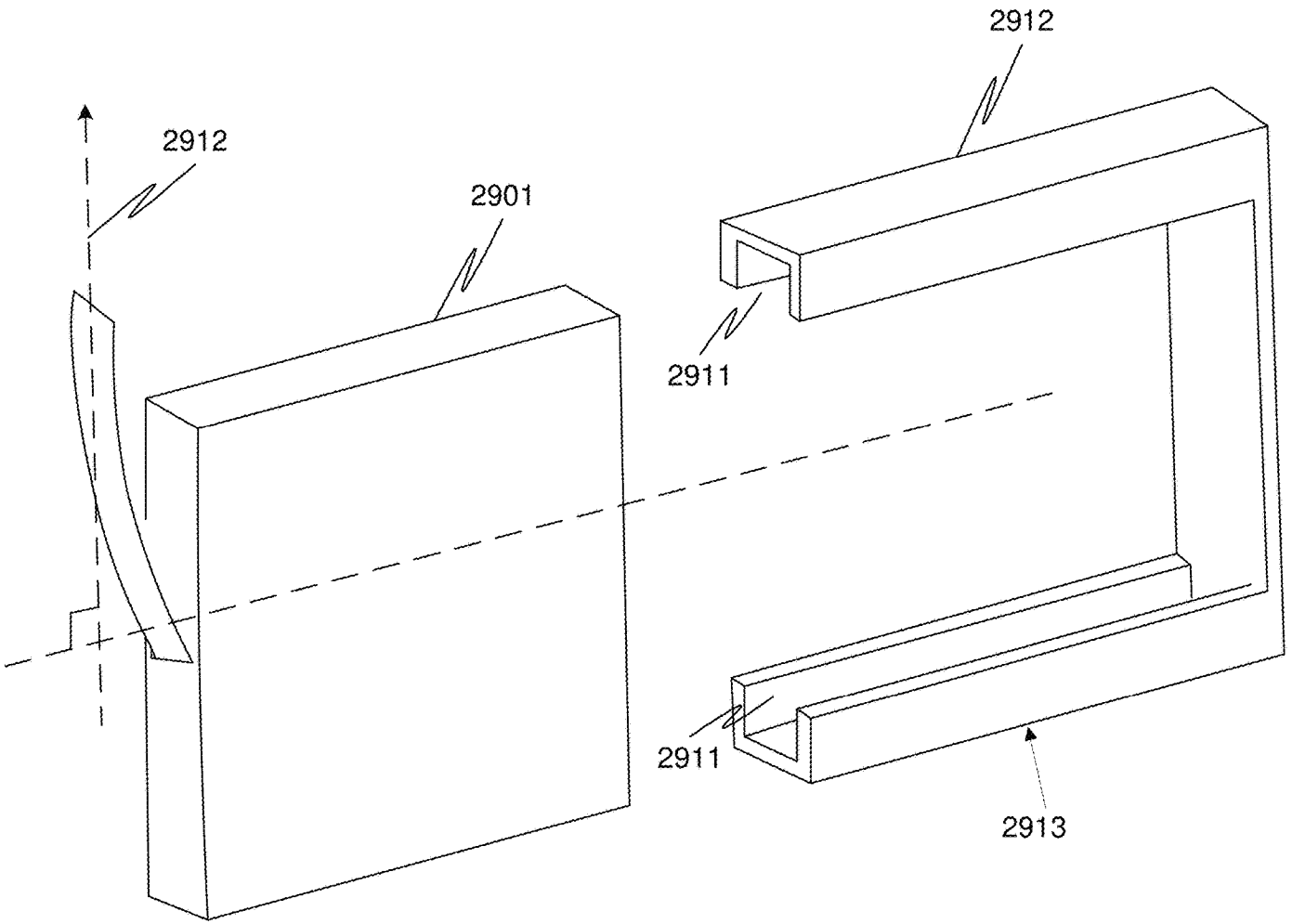
FIG. 29 illustrates another example of a single use tape dispenser box holder configuration.

Another configuration of a holder is illustrated in FIG. 29. Channels 2911 may be oriented in the reservoir perpendicularly to the principle direction of motion 2912 of the paper band. In this way, as the turn-up machine exerts a force on single-use box 2901 in the principle direction of motion 2912, holder 2913 may resist such motion. In some embodiments, an additional securing means, as described above, may be used to further attach the holder to the tape dispensing apparatus to assist in resisting spurious forces parallel to the principle direction of motion 2912 of the paper band.

Figure 30:
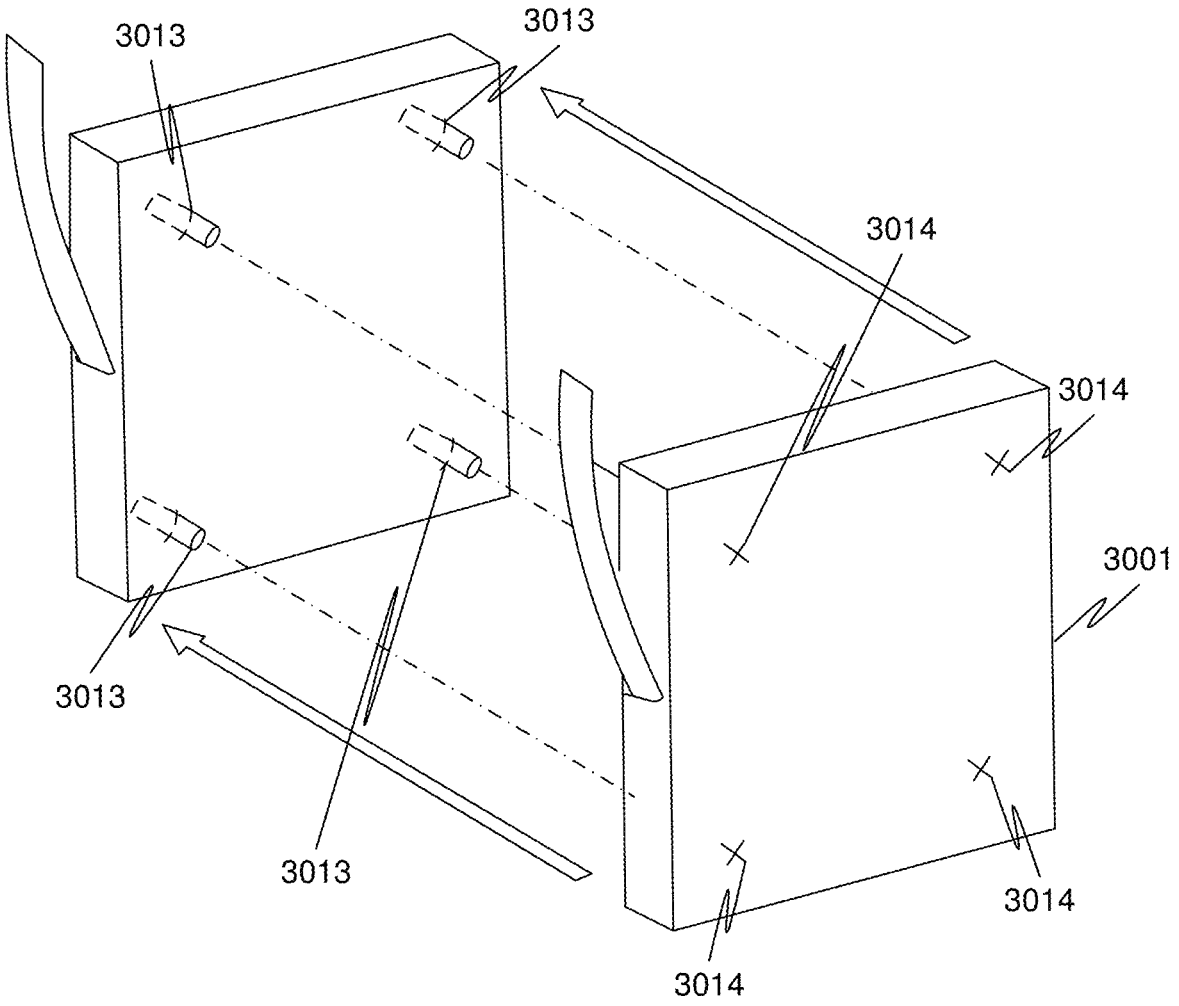
FIG. 30 illustrates another example of a single use tape dispenser box holder configuration.

Another tape dispensing box securing mechanism is illustrated in FIG. 30. Single-use box 3001 may be impaled on two or more pins 3013 in the reservoir that may be aligned with piercings 3014 in the front and back faces of single-use box 3001, such that the pins hold single-use box 3001 securely and enforce the correct orientation when seating the box in the turn-up mechanism by virtue of an asymmetrical arrangement of the pins, or by markings on the box itself. In some embodiments, pins 3013 may be fixedly attached to a portion of the turn-up mechanism, and single-use box 3001 may be impaled thereupon. In other embodiments, pins 3013 may be fixedly or pierced attached to single-use box 3001 and may interconnect with receiving portions on the turn-up mechanism or the holder.

Figure 31:
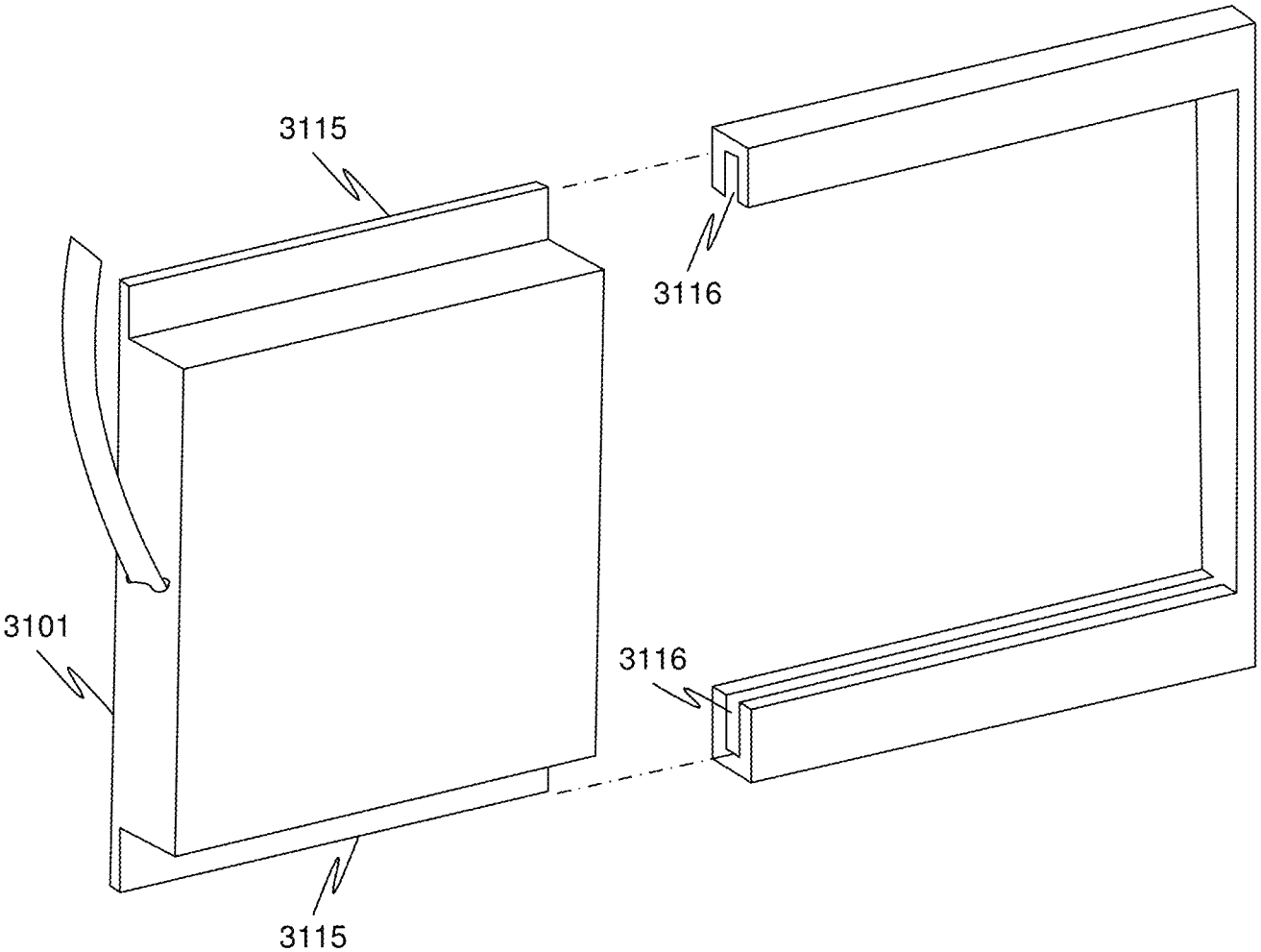
FIG. 31 illustrates another example of a single use tape dispenser box holder configuration.

Another tape dispensing box holder configuration is illustrated in FIG. 31. In this embodiment, wings 3115 may extend from at least two sides of single-use box 3101 to engage narrow channels 3116. Depending on the configuration of the turn-up mechanism, qualities of the paper, and the like, this embodiment may be preferable to the channel embodiment shown in FIG. 28. In some embodiments, the width of wings 3115 may be adjustable by, for example, sliders. This may allow the same single-use box 3101 to fit a variety of holders. In some embodiments, wings 3115 may have securing means (e.g., a clip, a slot, an adhesive) to which the proximal end of the paper band coil may be temporarily attached to prevent the paper band coil from telescoping or tangling during transit.

The single use tape dispensing boxes may be used with the tape dispensing apparatus described herein or with any suitable known or later invented transfer tape dispensing apparatus and methods. In embodiments wherein the proximal end of the paper band has adhesive pre-applied, methods of using a single-use tape dispensing box generally include releasing a proximal end of a coil of paper band in the box for use, such as by threading the proximal end through a slot in the sidewall of the box, or by releasing the proximal end of the paper band from a position secured outside the box; removing an adhesive liner from an adhesive on the proximal end of the paper band; and inserting the proximal end of the paper band into a track inlet of the transfer tape dispensing apparatus. Some methods further include placing the single-use dispensing box proximate to a transfer tape dispensing apparatus, such as in a holder in a reservoir of the tape dispensing apparatus. This may be performed before or after the proximal end of the coil of paper band is released from the box. After the paper tape has been inserted into the track inlet of a paper dispensing apparatus, any of the paper web turn up methods described herein may be used.

Figure 32:
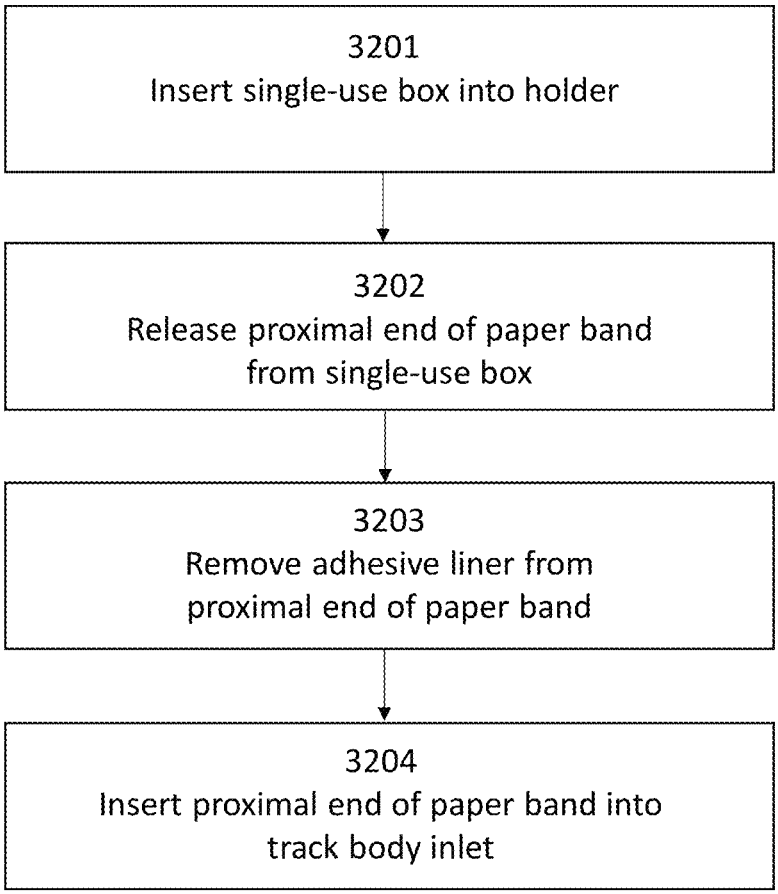
FIG. 32 provides a flow chart for method steps related to certain aspects of the invention.

Referring to FIG. 32, some embodiments of the invention include: inserting a single-use tape dispensing box into a holder (3201), such as a holder in a reservoir of a tape-dispensing apparatus; releasing a proximal end of the paper band from the single-use box (3202); removing an adhesive liner from the proximate end of the paper band (3203); and inserting the proximal end of paper band into a track body inlet of a tape dispensing apparatus (3204). As noted above, in some embodiments, step 3201 may be performed after step 3202, or even after step 3203. After insertion of the paper band into the tape dispensing apparatus, the turn-up tape may be loaded into the cross-machine track and then used to perform one turn-up cycle, whereby the transfer tape effects the sever and transfer of a paper web from a rotating full spool onto an empty spool.

In some embodiments of the invention, the paper band does not have pre-applied adhesive. As such, in these embodiments, methods of using a single-use tape dispensing box generally include releasing a proximal end of a coil of paper band in the box for use, such as by threading the proximal end through a slot in the sidewall of the box, or by releasing the proximal end of the paper band from a position secured outside the box; applying an adhesive to the proximal end of the paper band; and inserting the proximal end of the paper band into a track inlet of a transfer tape dispensing apparatus. Some methods further include placing the single-use dispensing box proximate to a transfer tape dispensing apparatus, such as in a reservoir of the tape dispensing apparatus. This may be performed before or after the proximal end of the coil of paper band is released from the box. After the paper tape has been inserted into the track inlet, any of the paper web turn up methods described herein may be used.

Figure 33:
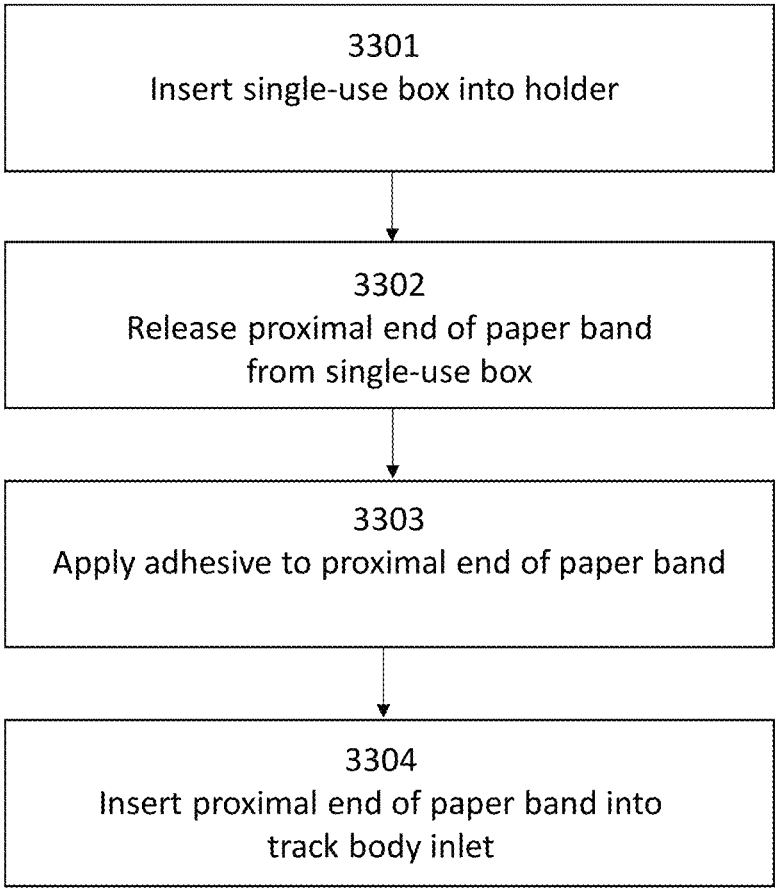
FIG. 33 provides a flow chart for method steps related to certain aspects of the invention.

Referring to FIG. 33, some embodiments of the invention include: inserting a single-use tape dispensing box according to the invention into a holder (3301), such as a holder in a reservoir of a tape-dispensing apparatus; releasing a proximal end of the paper band from the single-use box (3302); applying an adhesive to the proximate end of the paper band (3303); and inserting the proximal end of paper band into a track body inlet of a tape dispensing apparatus (3304). As noted above, in some embodiments, step 3301 may be performed after step 3302, or even after step 3303. After insertion of the paper band into the tape dispensing apparatus, the turn-up tape may be loaded into the cross-machine track and then used to perform one turn-up cycle, whereby the transfer tape effects the sever and transfer of a paper web from a rotating full spool onto an empty spool. In the methods described herein, any of the single-use transfer tape dispensing boxes of the invention may be used. Furthermore, the position proximate to the transfer tape dispensing apparatus may be within the apparatus (e.g., in a reservoir), and may be secured by any means, including a holder or other means described herein.

It is understood that equivalents and substitutions for elements or steps described above may be obvious to those of skill in the art, and therefore the true scope and definition of the invention is to be as set forth in the following claims.

We claim:

1. A turn-up tape dispenser for use in a paper web turn-up system as used in paper production, said turn-up tape dispenser adapted to deliver a primary tape and a secondary tape for a paper web turn-up procedure, the paper web turn-up tape dispenser comprising:

a primary tape dispensing module comprising a primary track body adapted to receive and hold the primary tape, and a primary drive mechanism adapted to move the primary tape along the primary track body, through a discharge end of the primary tape dispensing module, and through a cross-machine track of the paper web turn-up system as used in paper production;

a secondary tape dispensing module connected to the primary tape dispensing module and comprising a secondary track body adapted to receive and hold the secondary tape, and a secondary drive mechanism adapted to move the secondary tape along the secondary track body, through a discharge end of the secondary tape dispensing module, and through the cross-machine track of the paper web turn-up system as used in paper production, wherein the secondary drive mechanism comprises a hand crank; and wherein the primary tape dispensing module delivers the primary turn-up tape through the cross-machine track to perform turn-up procedures for the paper web turn-up system, but if the primary tape dispensing module fails to feed the primary tape, the secondary tape dispensing module then delivers the secondary tape through the cross-machine track of the paper web turn-up system and performs the turn-up procedures, even when the primary tape dispensing module is removed from the paper web turn-up tape dispenser.

2. The paper web turn-up tape dispenser of claim 1, wherein the primary tape dispensing module has a motorized drive mechanism and the secondary tape dispensing module has a manual drive mechanism.

3. The paper web turn-up tape dispenser of claim 1, further comprising a track adapter block connected to the discharge end of the primary tape dispensing module and the discharge end of the secondary tape dispensing module.

4. The paper web turn-up tape dispenser of claim 3, wherein the track adapter block joins the primary track body and the secondary track body into a single output track body.

5. The paper web turn-up tape dispenser of claim 3, wherein the track adapter block has a primary output track for the primary tape and a secondary output track for the secondary tape.

6. The paper web turn-up tape dispenser of claim 1, wherein at least one of the primary tape dispensing module and the secondary tape dispensing module comprises a unicharger device.

7. The paper web turn-up tape dispenser of claim 6, wherein the unicharger device is a motorized unicharger device.

8. The paper web turn-up tape dispenser of claim 1, wherein at least one of the primary tape dispensing module and the secondary tape dispensing module comprises a cutting device.

9. The paper web turn-up tape dispenser of claim 1, wherein at least one of the primary tape dispensing module and the secondary tape dispensing module comprises a mechanical counter.

10. The paper web turn-up tape dispenser of claim 1, wherein at least one of the primary tape dispensing module and the secondary tape dispensing module comprises a retractable stop.

11. The paper web turn-up tape dispenser of claim 1, wherein at least one of the primary tape dispensing module and the secondary tape dispensing module comprises a holder configured to secure a single-use tape dispenser box.

* * * * *